US008127589B2

(12) United States Patent
Battenfeld

(10) Patent No.: US 8,127,589 B2
(45) Date of Patent: Mar. 6, 2012

(54) PLIERS FOR PRESSING WORK PIECES

(75) Inventor: Kurt Battenfeld, Ebsdorfergrund-Wittelsberg (DE)

(73) Assignee: Wezag GmbH Werkzeugfabrik, Stadtallendorf (DE)

( * ) Notice: Subject to any disclaimer, the term of this patent is extended or adjusted under 35 U.S.C. 154(b) by 1094 days.

(21) Appl. No.: 11/970,679

(22) Filed: Jan. 8, 2008

(65) Prior Publication Data

US 2008/0163664 A1 Jul. 10, 2008

(30) Foreign Application Priority Data

Jan. 8, 2007 (DE) ..... 10 2007 001 235

(51) Int. Cl.
*B25B 7/12* (2006.01)
*B25B 7/00* (2006.01)

(52) U.S. Cl. ..... 72/409.12; 72/409.01; 81/427.5

(58) Field of Classification Search ..... 72/409.01, 72/409.07–409.09, 409.11, 409.12, 409.19, 72/451; 81/313, 342, 347, 348, 350, 351, 81/367, 369, 372, 375, 377, 378, 381, 383
See application file for complete search history.

(56) References Cited

U.S. PATENT DOCUMENTS

| | | | | |
|---|---|---|---|---|
| 2,283,933 | A | 5/1942 | Jones et al. | |
| 3,200,675 | A | 8/1965 | Willis | |
| 3,837,211 | A | 9/1974 | Gress et al. | |
| 4,005,516 | A | 2/1977 | Bakermans | |
| 4,170,154 | A | 10/1979 | Izraeli | |
| 5,267,464 | A * | 12/1993 | Cleland | 72/409.12 |
| 5,474,130 | A | 12/1995 | Davis | |
| 6,116,124 | A | 9/2000 | Ping | |
| 6,289,712 | B1 | 9/2001 | Beetz et al. | |
| 7,155,954 | B2 | 1/2007 | Battenfeld | |
| 7,886,570 | B2 * | 2/2011 | Cleland et al. | 72/409.1 |

FOREIGN PATENT DOCUMENTS

| | | | |
|---|---|---|---|
| DE | 1 527 910 | | 5/1973 |
| DE | 29 02 0344 | A1 | 8/1980 |
| DE | 29 02 344 | A1 | 8/1980 |
| DE | 41 01 284 | A1 | 7/1992 |
| DE | 196 44 807 | A1 | 5/1998 |
| DE | 197 09 639 | A1 | 9/1998 |
| DE | 198 34 859 | C2 | 1/2001 |
| DE | 199 63 097 | C1 | 4/2001 |
| DE | 199 24 087 | C2 | 6/2002 |
| DE | 103 46 241 | B3 | 8/2004 |
| EP | 0 838 309 | B1 | 3/2000 |
| GB | 1 095 683 | A | 12/1964 |

OTHER PUBLICATIONS

Search Report in related co-pending EP Application No. 07024617.8, mailed Apr. 17, 2009.

* cited by examiner

*Primary Examiner* — Debra Sullivan
(74) *Attorney, Agent, or Firm* — Thomas, Kayden, Horstemeyer & Risley, LLP

(57) ABSTRACT

Pliers for pressing work pieces such as mountings, electric contacts, cable lugs and fittings include a first hand lever and a second hand lever. The hand levers are movable with respect to one another. The pliers also include a head and at least two pressing jaws being located in the region of the pliers head and approaching one another during a working stroke of the pressing pliers to press a work piece. The working stroke includes a first partial stroke and a second partial stroke. The pliers also include a first transfer mechanism and second transfer mechanism.

11 Claims, 14 Drawing Sheets

PLIERS FOR PRESSING WORK PIECES

CROSS REFERENCE TO RELATED APPLICATIONS

This application claims priority to co-pending German Patent Application No. DE 10 2007 001 235.9 entitled "Presszange zum Verpressen von Werkstücken", filed Jan. 8, 2007.

FIELD OF THE INVENTION

The present invention generally relates to pliers or pressing work pieces. More particularly, the present invention relates to pliers for deforming mountings, electric contacts, cable lugs, fittings and the like by pressing.

BACKGROUND OF THE INVENTION

Pressing pliers may serve for realizing general pressing purposes or for electric purposes. In the later case, they are also designated as crimping pliers. Depending on the design of the work piece to be pressed and crimped, respectively, substantial pressing forces have to be applied to attain a desired plastic deformation of a work piece, the work piece being introduced between pressing die halves or die halves of the pressing pliers. The amount of the required pressing force may depend on

- the material of the work piece or of the work pieces when connecting a plurality of work pieces by pressing,
- the dimensions or the diameter of the work piece, and/or
- the plastic deformations desired during pressing.

For introducing the work piece between the pressing dies of the pressing pliers, the pressing pliers possibly need to have a great opening width to be capable of surrounding the work piece to be pressed by the die halves in the open position, even if the work piece has comparatively great dimensions. At the beginning of the closing movement of the pressing pliers, the forces to be applied by the user of the pressing pliers are rather irrelevant until the die halves contact the work piece in the closed position. During the actual pressing step, the pressing forces to be applied are substantial, the pressing force even increasing during the continued closing movement.

Pressing pliers are known from German patent application No. DE 197 09 639 A1. The known pressing pliers include two hand levers being movable with respect to one another and being operable by one hand. Furthermore, the pliers include two pressing jaws which are commonly rotatable about a common joint. One of the pressing jaws is fixedly connected to one hand lever such that the pressing jaw and the hand lever form a fixed pressing pliers portion, while the other pressing jaw is pivotally connected to the fixed pressing pliers portion by the joint. The pressing pliers include divided die halves being located at the pressing jaws and forming a pressing die. The known pressing pliers include a forced locking mechanism for attaining a defined end position of the die halves. A pressure lever is pivotally connected between the two hand levers by additional joints, the pressure lever together with the movable hand lever forming a toggle lever drive. The two die halves are designed as one piece with the respective pressing jaw and as precision casting elements.

According to German patent No. DE 199 24 087 C2 corresponding to U.S. Pat. No. 6,289,712 B1, the die jaws are being inserted in the pressing jaws in a replaceable way. In this way, different die halves can be used in the same pliers for different work pieces. The die halves may be supported with respect to the pressing jaw with a clearance. In this way, a centering adaptation in the direction of the separation plane of the die halves is possible.

One drawback of the above described prior art pressing pliers is that there is a fixed dependency between the opening angle of the pressing jaws, on the one hand, and of the hand levers, on the other hand. The dependency is influenced by the toggle lever drive. Consequently, a maximum opened position of the pressing jaws results in a maximum opened position of the hand levers. This may be disadvantageous, for example, when the pressing pliers with the die halves have to be moved over a work piece when there only is little space. In some cases, this movement with the fully opened hand levers is not possible. Furthermore, when using the known pressing pliers, it has been found that the user is only capable of applying limited forces when the hand levers are wide open, whereas increased actuation forces can be supplied when the hand levers are further closed and can be grasped by one hand or with both hands.

According to German patent No. DE 199 63 097 C1 corresponding to U.S. Pat. No. 6,474,130 B2, this drawback can be reduced or eliminated by the hand lever being supported at the associated pressing jaw at its side facing the pressing jaws including a pivot joint by which the handle part of the hand lever may be pivoted into a first working position with respect to the remaining part of the hand lever being connected to the pressure lever and the pressing jaw, while the handle part in a second working position can be arranged in an angled position in the direction of the fixed hand lever with respect to the other part. Especially for great opening angles of the hand lever and thus of the pressing jaws in the second working position, the angle between the parts of the hand levers being held by one hand or by two hands of the user and thus their distance can be reduced. In this case, the pivotal connection is realized by two guiding pins being guided in suitably curved elongated channels.

According to German patent No. DE 103 46 241 B3 corresponding to U.S. Pat. No. 7,155,954 B2, this basic concept of allowing for different variable cranked designs of a hand lever has been expanded by locating a stop locking mechanism between the part of the hand lever facing the pressing jaw and the handle part of the moved hand lever. The part of the hand lever facing the pressing jaw at its end portion facing the other part of the hand lever includes a snap-in design along which a snap-in element is moved and engages suitable snap-in channels while the orientation of the pivotal connection changes. The snap-in element is designed to be subjected to the force of a spring, and it is supported with respect to the handle part of the hand lever. The use of the stop locking mechanism allows for different cranked designs of the moved hand lever being effective during different partial strokes when moving the pressing jaw from an open position into a closed position. This makes it possible to conduct separate partial strokes during the closing movement with the same distance between the handles of the hand levers. This may also be achieved by using one hand only. The pivotal connection between the two parts of the moved hand lever is realized by a joint being located at the pressure lever at the side facing away from the pressing jaws and at the part of the hand lever facing the pressing jaw. A simplified design may be attained when this joint is formed together with the joint between the front part of the moved hand lever and the associated pressing jaw. Furthermore, this prior art reference suggests to provide a partial stroke for great opening angles of the pressing jaws for which no pressing forces have to be applied by the pressure lever being movably guided between the two hand levers from its working position in an elongated hole with respect to the fixed hand lever.

Pressing pliers including two hand levers being movable with respect to one another are known from U.S. Pat. No. 4,170,154. The ends of the hand levers are connected to pressing jaws being connected to a common joint. A forced locking mechanism including additional parts is located between these two hand levers, the forced locking mechanism including a tooth segment and a pivotally supported locking tooth. The forced locking mechanism serves to reach a defined end position during the closing movement of the pressing jaws. The pressing pliers only allow for a one-step closing movement of the pressing jaws while the hand levers approach one another.

Pressing pliers having a variable adjustable jaw opening are known from U.S. Pat. No. 6,116,124. The known pliers include two hand levers being movable with respect to one another, each of the hand levers being fixedly connected to the respective pressing jaw. Some kind of a forced locking mechanism is located between the two hand levers. One of the supporting locations of the forced locking mechanism is supported to be movable by the force of a spring. Each hand lever of these pressing pliers is designed as one piece with the associated pressing jaw.

Pressing pliers in which the pressing jaws are guided to fulfil a translatory relative movement are known from German patent application No. DE 29 02 344 A1. For this purpose, one hand lever together with the fixedly connected pliers head forms a translatory guiding element for an elongated part of the movable pressing jaw. A movable hand lever is supported by a joint, the joint being stationary with respect to the fixed hand lever. A pressure lever is arranged between the movable elongated part and the movable hand lever. The pressure lever in an end portion is supported at a joint pin of the movable elongated part. At its opposite end portion, it is supported in an elongated hole of the movable hand lever at a joint pin being fixedly connected to the pressure lever. In this way, a toggle lever drive is formed by the movable elongated part, the pressure lever and the movable hand lever. Alignment of the elongated channel with respect to the components of the toggle lever drive is realized in a way that a comparatively great gear up ratio of the toggle lever drive is attained for opening and closing of the pressing pliers to allow for insertion of a pressing die. However, no pressing forces or only low pressing forces can be attained for this gear up ratio. For this opening and closing stroke, the joint pin is located in an end portion of the elongated hole, while it glides more or less quickly in the direction of the other end portion of the elongated hole during continued closing movement of the pressing pliers. Thus, different geometric conditions and different force transmission result for the toggle lever drive including the same components. The components forming the toggle lever drive remain unchanged for the above described switching step, whereby there only exist limited possibilities of attaining different gear ratios. Furthermore, relevant pressing forces can only be produced after the above described gliding movement of the joint pin from one end portion of the elongated hole into the other end portion of the elongated hole. Consequently, a pressing stroke for pressing the die only occurs in this "partial stroke".

One single toggle lever drive is also known from German patent No. DE 198 34 859 C2. In this case, for allowing for an opening stroke and a closing stroke for which no pressing of the die is possible, the pressure lever is designed to include two parts and to be integrated in the pressing pliers such that the effective length of the pressure lever is variable during the opening stroke.

German patent No. DE 1 527 910 C corresponding to British patent No. GB 1,095,683 A discloses pressing pliers including three hand levers. Pressing of a die is attained in two partial strokes: in a first partial stroke, a first hand lever is pivoted with respect to the second and third hand lever. This results in a relative movement of two jaws with respect to one another. A die is deformed between the jaws during a first partial stroke such that it attains an oval shape. When the first partial stroke is completed, there is a relative movement between the second and third hand levers such that they approach one another. The position of the above mentioned jaws does not change during this relative movement. Instead, an additional third pressing element is moved to approach the die with respect to the above mentioned jaws depending on the movement of the second and third hand lever. This results in the oval shape of the die being deformed into a round shape. Consequently, different pressing jaws or pressing elements are used during different partial strokes.

Pressing pliers including three hand levers are also known from U.S. Pat. No. 2,283,933.

SUMMARY OF THE INVENTION

The present invention relates to pressing pliers for pressing work pieces. The pressing pliers include a first hand lever and a second hand lever. The first and second hand lever are designed and arranged to be movable with respect to one another. The pliers also include a pliers head and at least two pressing jaws being located in the region of the pliers head and being designed and arranged to approach one another during a working stroke of the pressing pliers to press a work piece. The working stroke includes a first partial stroke and a second partial stroke. The pliers also include a first transfer mechanism being formed by a first toggle lever drive. The first toggle lever drive includes a first toggle joint being formed by a first joint. The first toggle lever drive is designed and arranged to transmit forces applied by a user to the hand levers to the pressing jaws to produce a pressing force during the first partial stroke. The pliers also include a second transfer mechanism being formed by a second toggle lever drive. The second toggle lever drive includes a second toggle joint being formed by a second joint. The second toggle lever drive is designed and arranged to transmit forces applied by a user to the hand levers to the pressing jaws to produce a pressing force during the second partial stroke.

The present invention also relates to pressing pliers including a first transfer mechanism being designed and arranged to attain the first partial stroke by moving the first and second hand lever with respect to one another in a first direction. The pressing pliers also include a second transfer mechanism being designed and arranged to attain the second partial stroke by moving the first and second hand lever with respect to one another in a second direction other than the first direction.

Compared to prior art pressing pliers, the novel pliers have been improved with respect to

- their operation and functionality, respectively,
- the attainable pressing forces,
- the possibilities of using them when there only is little space, and/or
- the range of application for pressing work pieces, for example the maximum diameter and/or the usable materials to be pressed with the novel pliers.

While the above described pliers according to the prior art are based on the general concept of using an unchanged toggle lever drive during the working stroke from the open position to the closed position of the pressing pliers in which at the most the cranked design of a hand lever can be changed by the stop locking mechanism, the present invention suggests to divide the working stroke of the pressing jaws into a first partial stroke and a second partial stroke. The pressing force in the two partial strokes is produced by using different transfer mechanisms. These transfer mechanisms may also be designated as "kinematics units". For example, the different transfer mechanisms or kinematics units used in the two partial strokes may include

- the use of different structural elements when transmitting force from a hand lever being operated by a user to the pressing jaws,
- changed kinematics relations between the structural elements, for example by changing a length of a lever, changing the supporting location, and the like,
- a determination and release, respectively, of a degree of freedom of a joint, and/or
- actuation of different structural elements.

Each of the two transfer mechanisms may be designed as a toggle lever drive including different toggle joints, the toggle joints being formed by different structural elements.

The use of a toggle lever drive for pressing pliers has been found to be advantageous with respect to

- the use of the levers and joints,
- the attainable precision during pressing of the work pieces,
- the stiffness during the transmission of forces, and
- the attainable gear up ratios.

The use of different transfer mechanisms may especially be suitable for the following purposes and for attaining the following advantages, respectively:

- Different gear up ratios between the force supplied to the hand levers and the forces acting upon the pressing jaws can be realized for the first and second partial stroke. For example, this may be used to choose a smaller gear up ratio in a first partial stroke such that smaller forces are produced at the pressing jaws with the respective actuation forces, but the pivotal movement of the hand levers results in quick and extensive partial closing of the pressing jaws. The required pressing forces are smaller in the first partial stroke starting from the open position compared to the following second partial stroke leading to complete closing of the pressing pliers.
- Special requirements with respect to the free assembly space when using the pressing pliers are taken into account by providing two partial strokes with different transfer mechanisms.
- Due to the choice of the transfer mechanisms and the transmission ratios resulting therefrom, it is possible to allow for especially sensitive setting of the pressing force at the pressing jaws during a partial stroke. This may result in an improved final condition of the pressed work piece.
- The subdivision into two partial strokes may predetermine a defined intermediate position for the user, for example, by a locked transition from the first partial stroke to the second partial stroke, such that the user is capable of concentrating on the following partial stroke, for example, after a short break and after having rebuilt and/or after grasping the hand levers in a different way.
- It is possible for the user to differentiate less critical parts from more critical parts of the working stroke due to the two partial strokes.

In another or cumulative exemplary design of the novel pliers, the hand levers are pivoted with respect to one another in different directions for the two partial strokes and the different transfer mechanisms such that the hand levers are pressed towards one another during one partial stroke, and they are pivoted in a direction away from one another during the other partial stroke. This design is based on the perception that a maximum opening angle of the hand levers or their distance in the open position may be predetermined in the first place. For example, this may result from the kind of use of the pressing pliers by the user and/or the ambient conditions during use of the pressing pliers. During the (usual) movement of the hand levers from the open position into the closed position in which the hand levers are moved in one direction, especially to approach one another, the above mentioned maximum angle results from the partial angles for the two partial strokes. This means that only a part of the maximum angle is available to the partial stroke. As a result, the transfer mechanism needs to provide an increased transmission ratio which counteracts sensitive actuation of the pressing pliers. Due to the different transfer mechanisms being used according to the invention pivoting the hand levers in different directions, the maximum angle may be completely used for one partial stroke or especially for both partial strokes. This may be used for

- an increase of the working stroke attainable with the pressing pliers,
- more sensitive actuation of the pressing pliers,
- reduced required transmission ratios, and/or
- reduced required actuation forces.

Furthermore, the partial strokes may be clearly differentiated for the user due to the different moving directions.

According to another exemplary embodiment of the novel pressing pliers, the pressing pliers include a first hand lever, a second hand lever and a third hand lever. For example, a transfer mechanism for which forces are applied onto the first and second hand lever by the user is used. Forces are transmitted from the first and second hand lever to the pressing jaws by a first transfer mechanism during the first partial stroke. The first partial stroke may be completed as desired by the user, or it may be predetermined, for example, by a stop or an adjacent structural element being contacted by a hand lever or by a structural element of the transfer mechanism. For realizing the second partial stroke, the user applies forces to the first hand lever, on the one hand, and to the third hand lever, on the other hand. The forces are transmitted to the pressing jaws by the second transfer mechanism. Furthermore, it is possible to produce a pressing force for a third partial stroke with a third transfer mechanism due to the user actuating the second and third hand lever. The first and second partial stroke may immediately follow one another, or they may be designed to partly overlap.

The concept of the invention may also be roughly summarized in pressing the work piece in two partial strokes with two different individually adapted pliers, these two pliers being combined to one novel pressing pliers. In this way, one attains a compact tool as a unit. For this unit, single structural elements may be used in a multifunctional way for using both "pliers". This may result in minimization of the material expenditure and a reduced total weight. Furthermore, according to the novel design, both "pliers" operate with the same pressing jaws such that for a change from one "pliers" to the other "pliers", the pliers after a partial stroke do not have to be reopened intricately, they do not have to be removed from the work piece, the other "pliers" do not have to be brought in their maximum open position, and they do not have to be brought in contact with the work piece for the second partial stroke. During the above described change, there could also be a variation of the position between the work piece and the corresponding parts of the pressing jaws of the first "pliers" and of the second "pliers". This is prevented according to the present invention. Instead, the pressing jaws of the novel pliers may remain in contact to the work piece during a change from the first partial stroke to the second partial stroke and during use of the first "pliers" and following use of the second "pliers".

Another exemplary embodiment of the novel pressing pliers includes a switching unit allowing for switching from the first transfer mechanism to the second transfer mechanism. For example, with such a switching unit, the combination of two "pliers" to the novel pliers may also be realized without arranging three hand levers. This is realized by the same hand levers being subjected to actuation forces by the user during both partial strokes, but the switching unit resulting in different transfer mechanisms being used. For example, the switching unit may make use of a determination of a degree of freedom or release of a degree of freedom, a change of the lever ratios, a change of the support location, and the like.

According to another proposal of the invention, the novel pliers include a manual actuation element by which the user may specifically switch from the first transfer mechanism to the second transfer mechanism and/or vice versa. This manual switching operation may be achieved by providing a suitable locking mechanism only for an ending of the first partial stroke or during the entire partial stroke when being requested by the user.

According to another exemplary embodiment of the novel pressing pliers, switching from the first transfer mechanism to the second transfer mechanism (and/or vice versa) occurs automatically. For example, this may be realized by motion control when reaching the ending of the first partial stroke. Furthermore, it is possible to realize the switching step by force control, for example when a threshold value of the pressing force at the pressing jaws is exceeded. It is also possible to use an additional manual actuation element for realizing some sort of bypass of the automatic switching action from the first transfer mechanism to the second transfer mechanism.

In prior art pressing pliers, an open position of the pressing jaws is correlated with a maximum opening of the hand levers. Instead, according to another exemplary embodiment of the novel pressing pliers, the pressing jaws have a (maximum) open position in the closed position of the hand levers. This is advantageous when the pressing pliers are to be pushed over a work piece in narrow ambient conditions. In such a case, a projecting, bulky opening of the hand levers would be disadvantageous.

In another exemplary embodiment of the novel pressing pliers, a hand lever in an end portion is pivotally connected to a pendulum support in the first partial stroke, while the other end portion of the pendulum support is pivotally connected to a pressing jaw. The pendulum support and the hand lever form a toggle lever. In the second partial stroke, another hand lever or the other hand lever is directly pivotally connected to the pressing jaw. In this case, the other hand lever and the pressing jaw form a toggle lever.

A pendulum support in the sense of the invention is to be approximately understood as a rod-shaped, bent or straight element for transmitting force, the element preferably transmitting a force from one end portion to the opposite end portion.

In another exemplary embodiment of the novel pressing pliers, the switching unit is designed in a way that it determines the degree of freedom of the above described pendulum support with respect to the hand lever (at least in one direction of movement). This results in an elongation of the hand lever to the pressing jaw.

For automatically switching from the first partial stroke to the second partial stroke at the ending of the first partial stroke, preferably the toggle lever, the pendulum support, and/or a joint connecting the toggle lever and the pendulum support contact a stop in the moving direction of the first partial stroke. The stop may be provided by an adjacent structural element. In this way, the partial stroke may be limited, on the one hand, and/or a degree of freedom can be determined at one side. Another stop is also effective in the region of the end of the first partial stroke and in the transition region to the second partial stroke, respectively. The toggle lever, the pendulum support and/or a joint connecting the toggle lever and the pendulum support contact the stop in a direction against the moving direction for the first partial stroke. In this way, the degree of freedom in the opposite direction is also limited. For example, the additional stop may become effective by manual actuation of the actuation element by the user. Furthermore, it is possible that the stop becomes effective automatically, for example by a motion controlled or force controlled stop element. Especially when reaching the ending of the first partial stroke, a displacement degree of freedom of the actuation element is released in a distance controlled way such that at the ending of the first partial stroke the actuation element starts moving due to a subjected force reservoir, for example a spring, such that the additional stop becomes effective.

Preferably, the above mentioned stops become effective approximately 2° to 10°, especially 3° to 4°, before or after an extended position of the toggle lever drive mechanism. In this way, it may be possible to make use of a great working stroke and thus a great angle region of the toggle lever. On the other hand, an end position in which the toggle lever is fully expanded is prevented. Such a position could be a locking position and/or could result in uncontrolled moving condition with "snapping off" from the extended position in both directions.

When the stops become effective at the above mentioned angle regions after the extended position, the pressing jaws are maximally closed when reaching the extended position. The pressing jaws fulfill a slight opening movement until the stop is reached. In this way, the change from the first partial stroke to the second partial stroke does not occur at maximum load of the respective structural elements. On the other hand, this results in little hand forces having to be initially applied at the beginning of the second partial stroke. These hand forces serve to undo the above mentioned slight opening movement before the actual pressing operation is continued.

According to another aspect of the present invention, the hand lever includes a stop locking mechanism. For this design, the designs and advantages known from the above mentioned prior art references may be integrated in the present invention. Parts of the hand lever may be arranged at different angle positions with respect to one another, especially in two or more angle positions, by the stop locking mechanism.

For another embodiment of the present invention, a forced locking mechanism is integrated in the novel pressing pliers. Corresponding to the above mentioned prior art references and the advantages resulting therefrom, the forced locking mechanism serves to secure the defined intermediate position of the pressing jaws at one side during the working stroke and during at least one partial stroke, respectively.

Preferably, the exemplary designs according to the invention are used for pressing pliers having a structural length which is less than approximately 800 mm. The above mentioned toggle lever drives are designed such that a pressing force of more than approximately 50,000 N, especially more than approximately 60,000 N, are attainable when the hand forces of a user are less than approximately 400 N. When using such comparatively small pressing pliers, the mentioned pressing forces could not be attained with pressing pliers known from the prior art.

In another exemplary embodiment, the pressing pliers in the region of the pressing jaws include pressing dies or die halves having a diameter for a fitting of at least approximately 20 mm, especially at least approximately 25 mm, 28 mm or 32 mm. Such great fittings could not be pressed with manually operated pressing pliers according to the prior art. Instead, mainly hydraulic pressing units were used for this purpose.

According to another design according to the invention, for the first time hand actuated pressing pliers are used for pressing a fitting of copper or stainless steel while pressing forces being greater than approximately 40,000 N, especially greater than 50,000 N, 55,000 N or 60,000 N, are produced. The pressing forces to be applied depend on the stiffness of the fitting which in turn may depend on the stiffness of the material chosen for the fitting and on the wall thickness of the fitting. While until now manually operated pressing pliers were used to produce smaller pressing forces up to 33,000 N, the present invention for the first time allows the use of manually operated pressing pliers for pressing fittings with greater required pressing forces. This may be achieved even with hand forces being less than approximately 400 N and with the use of novel pressing pliers having a total length being less than approximately 800 mm or which are even smaller than 700 mm or even 600 mm.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Referring now in greater detail to the drawings, the figures illustrate exemplary embodiments of novel pressing pliers 1. For example, the pressing pliers 1 serve to deform mountings, tubes, electric contacts, cable lugs, fittings and other similar work pieces by pressing. Pressing is realized by manual actuation, meaning by a human user applying forces, without requiring electric, pneumatic or hydraulic power support. Preferably, the pressing pliers 1 have a structural length which is less than 800 mm, especially less than 700 mm or 600 mm. It is possible to attain pressing forces with the pressing pliers 1 being greater than 40,000 N, especially 50,000 N or 60,000 N by hand forces of a user which are less than 400 N. When using the pressing pliers 1 for pressing and deforming, respectively, a fitting, the fitting may have a diameter of more than 20 mm, especially more than 25 mm, 28 mm or 32 mm.

Figure 1:
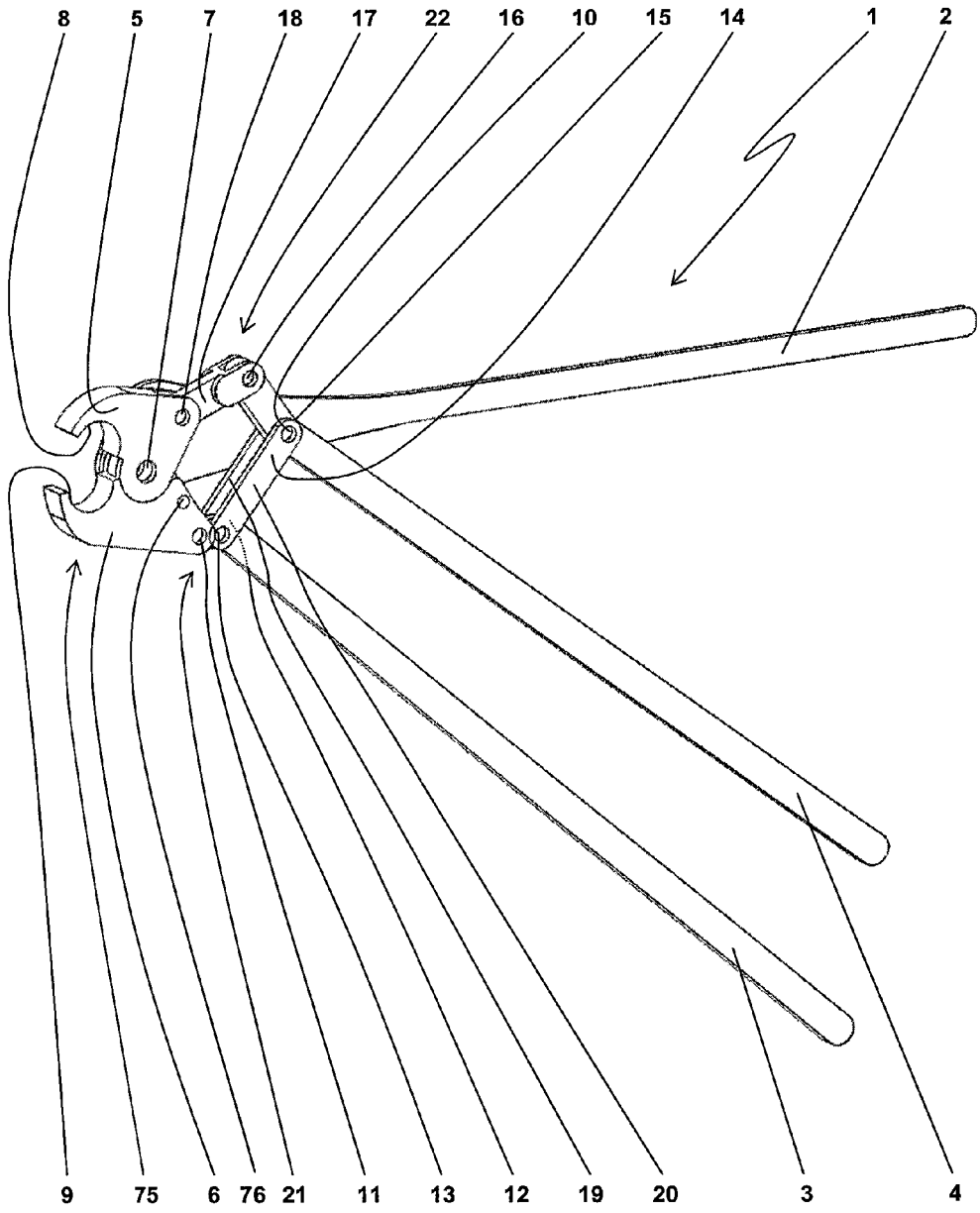
FIG. 1 is a three-dimensional view of a first exemplary embodiment of the novel pressing pliers including three hand levers, the pressing pliers being illustrated in their open position at the beginning of a first partial stroke.
Figure 2:
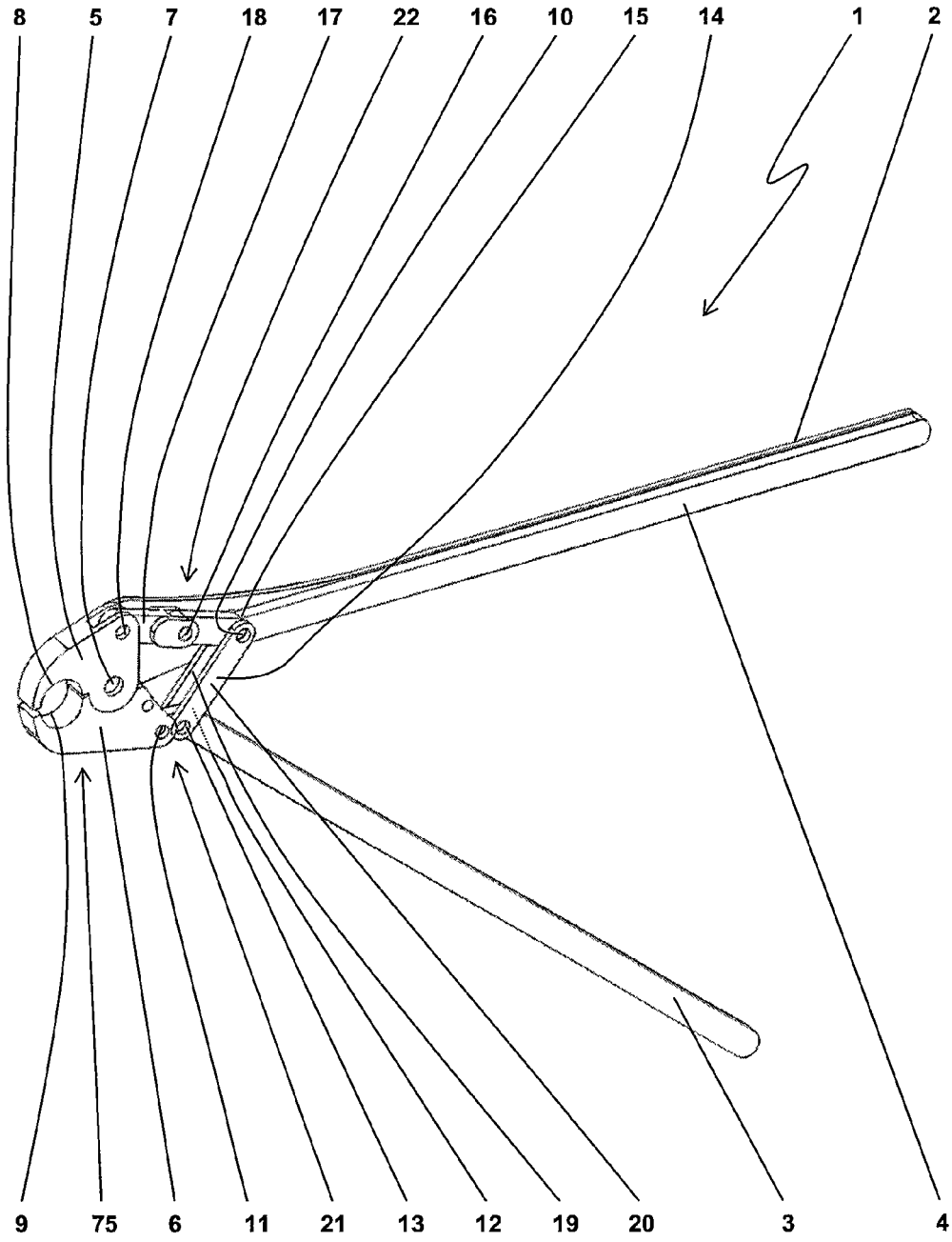
FIG. 2 is a three-dimensional view of the novel pressing pliers according to FIG. 1 at the ending of the first partial stroke and at the beginning of the second partial stroke, respectively.
Figure 3:
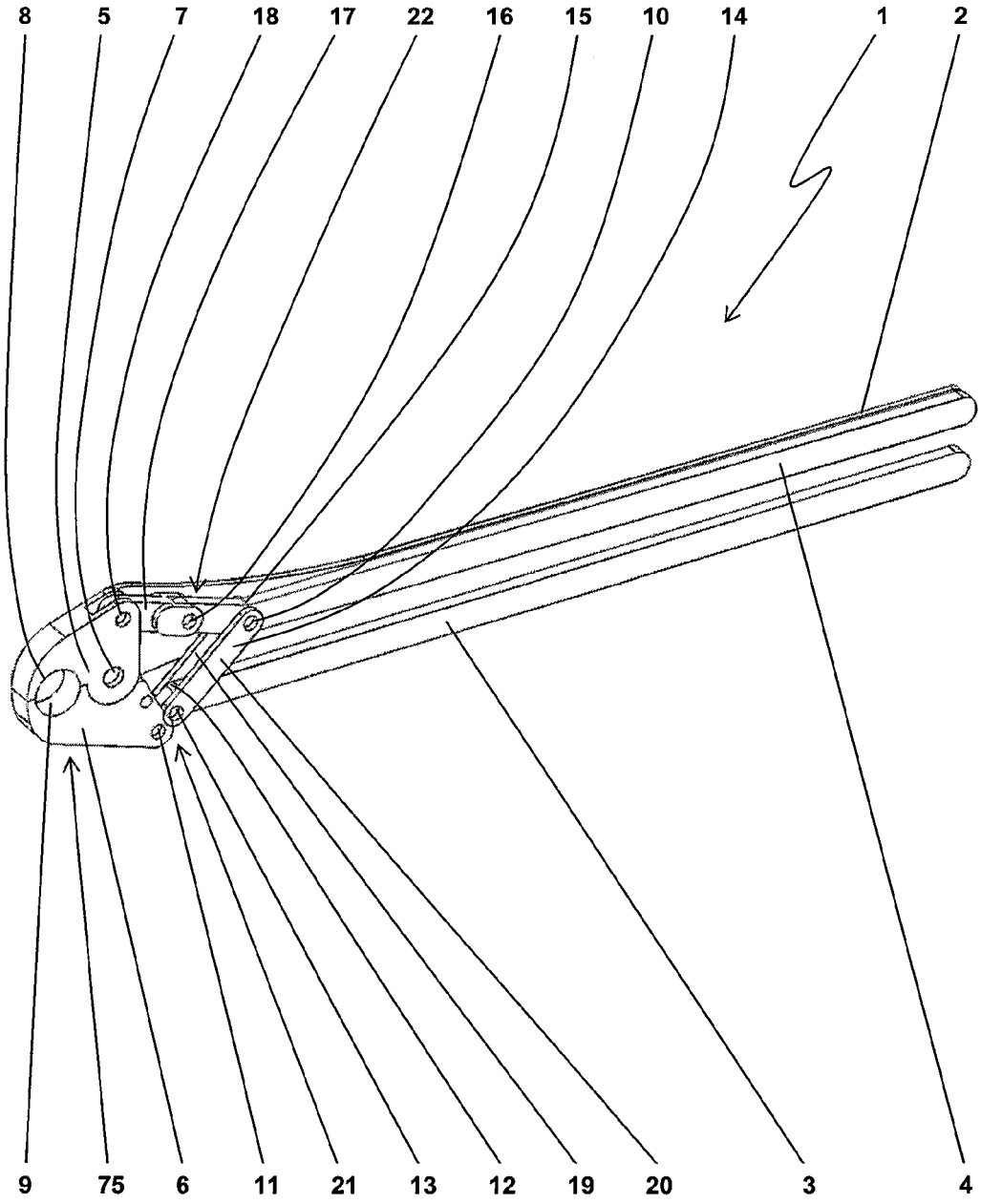
FIG. 3 is a three-dimensional view of the novel pressing pliers according to FIGS. 1 and 2 in their closed position at the ending of the second partial stroke.

FIGS. 1 to 5 illustrate the pressing pliers 1 including three hand levers 2, 3, 4. The series of FIGS. 1 to 3 illustrates a working stroke of the pressing pliers 1 starting from an open position according to FIG. 1 with a first partial stroke towards an intermediate position according to FIG. 2 and a second partial stroke starting from the intermediate position according to FIG. 2 into a closed position according to FIG. 3.

The pressing pliers 1 include pressing jaws 5, 6 which are interconnected in a pivotable manner by a joint 7 to allow for an opening movement and a closing movement. The figures do not illustrate the die halves 8, 9 in greater detail. It is to be understood that the die halves 8, 9 are the region in which the pressing forces are applied to the work piece. The die halves 8, 9 may be designed integral with the pressing jaws 5, 6, or they may be designed to be removable and replaceable, respectively, from the pressing jaws 5, 6.

The hand lever 2 is directly supported at the joint 7. Furthermore, the hand lever 2 includes another joint 10 being located between the end portion of the hand lever 2 being actuated by the hand of the user and the joint 7. The hand lever 2 includes an extension between the joints 7, 10, the extension being arranged to face away from the connecting line between the joints 7, 10.

The hand lever 3 in its end portion facing the pressing jaw 6 includes a cranked portion 12 such that when the straight portion of the hand lever 3 is located to be parallel to the hand lever 2, the cranked portion is angled with respect to the hand lever 2 by approximately 30° to 60°. The hand lever 2 in this end portion is pivotally connected to the pressing jaw 6 by a joint 11. The hand lever 3 in the region of the cranked portion 12 is connected to an end portion of a pressure lever 14 by a joint 13.

The hand lever 4 in its end portion facing the pressing jaws 5, 6 in the region of the cranked portion 15 is also designed to face slightly in an outward direction, for example at an angle of approximately 10° to 25°. In the region of the cranked portion 15, the hand lever 4 is pivotally connected to the end portion of the pressure lever 14 opposite to the joint 13. The end portion of the hand lever 4 being located opposite to the end portion being used by the user is connected to a pendulum support 17 by a joint 16. The pendulum support 17 at its opposite end portion is connected to the pressing jaw 5 by a joint 18.

The exemplary embodiment of the novel pliers 1 illustrated in FIGS. 1 to 5 includes the pressure lever 14 including two struts 19, 20 being located at both sides of the hand levers 3, 4 and each being connected to the joints 10, 13. The hand lever 3 in the region of the joint 11 is supported in a fork-shaped support of the pressing jaw 6. The same correspondingly applies to the pendulum support 17. The pendulum support 17 in the region of the joint 16 has a fork-shaped design, and it contacts the hand lever 4 from both sides. The pivot axes of the joints 11, 13, 10, 16, 18 and 7 are arranged to be parallel with respect to one another and to protrude out off the plane of illustration of FIGS. 1 to 5.

The illustrated exemplary embodiment of the novel pressing pliers 1 includes two toggle lever drives 21, 22:

The joint 11 forms the toggle link or "knee" for the toggle lever drive 21. The toggle levers are formed by the rigid connection of the pressing jaw 6 between the joint 7 and the joint 11, on the one hand, and by the rigid connection of the hand lever 3 between the joints 11, 13, on the other hand.

The joint 16 forms the toggle link or "knee" for the toggle lever drive 22. The toggle levers are formed by the rigid connection by the pendulum support 17 between the joints 16, 18, on the one hand, and by the rigid connection of the hand lever 4 between the joints 10, 16 on the other hand.

When actuating the pressing pliers 1, external forces are introduced by the hand levers 3, 4 into the toggle levers. Additional forces may at least be supplied onto the joints 16, 11 during a partial stroke, for example for determining a degree of freedom of the toggle lever.

The function and operation, respectively, of the pressing pliers 1 during a working stroke from FIG. 1 to FIG. 3 is as follows:

For the first partial stroke taking place from FIG. 1 to FIG. 2, the hand levers 2, 4 are subjected to actuation forces by the user. In this way, the hand levers 2, 4 are subjected to approach one another in a way that the hand lever 4 is moved in the direction of the hand lever 2. Transverse forces applied to the hand lever 4 by the user lead to increased transverse forces in the region of the joint 16 due to the hinged, but rigid support by the pressure lever 14. As a result, there is an increased pressure force in the pendulum support 17. Due to the fact that the axis formed by the pendulum support 17 does not extend through the joint 7, but instead in a way to form a lever arm, the normal force in the pendulum support 17—and thus the geared up actuation force of the user onto the hand lever 4—is transferred into a momentum acting upon the pressing jaw 5, the momentum acting in the direction of the closed position of the pressing jaws 5, 6. Gearing up of the actuation force of the user to attain an increased pressing force in the region of the pressing jaw 5 especially depends on the location of the jaw 10 between the end portions of the hand lever 4 and the above mentioned lever arm of the pendulum support 17.

A stop pin 76 ensures that the position of the pressing jaw 6 with respect to the hand lever 2 is fixedly determined at one side such that the pressing jaw 6 located in the open position illustrated in FIG. 1 cannot be further pivoted with respect to the hand lever 2 in the opening direction. On the other hand, a closing movement of the pressing jaw 6 within the second partial stroke is possible. For example, the stop pin 76 during the first partial stroke may be supported at the bottom side of the hand lever 2.

In this way, the toggle lever drive 22 serves for closing the pressing jaws 5, 6 during the first partial stroke.

When the hand levers 2, 4 are arranged to be parallel and to overlap in accordance with FIG. 2, there is the transition from the first partial stroke towards the second partial stroke which results in continued closing movement starting from the intermediate position illustrated in FIG. 2 towards the closed position illustrated in FIG. 3. The hand levers 2, 4 are fixedly located with respect to one another during the second partial stroke. For example, such fixation may be realized by the user simultaneously contacting the hand levers 2, 4 with his hands. In this way, an additional supporting surface is attained. Alternatively or additionally, a switching unit may be arranged. For example, the switching unit ensures limitation of the movement of the hand levers 2, 4 with respect to one another in one direction or in both directions in the region of the hand levers 2, 4, the joint 16, the joint 18, the pressing jaw 5 and/or the pendulum support 17. The switching unit may be manually operated by the user and/or it may be automatically actuated when reaching the intermediate position illustrated in FIG. 2. For example, such automatic actuation may be power controlled or path controlled. In this way, the elements 2, 4, 17, 5 form solid pliers half during the second partial stroke. The degrees of freedom are determined by the joints 16, 18.

For realizing the second partial stroke, the hand levers 2, 4, on the one hand, and the hand lever 3, on the other hand, are pushed towards one another by the user. Transverse forces being supplied to the hand lever 3 by the user are transferred (i.e. geared up corresponding to the lever conditions at the hand lever 3) to the pressing jaw 6 by a component being oriented in a vertical direction with respect to the connecting axis between the joints 7, 11. The distance between the joints 11, 7 forms a lever arm for the aforementioned component. In this way, the aforementioned component produces a momentum for the pressing jaw 6, the momentum acting about the joint 7 and in the closing direction of the pressing jaws 5, 6. The gear up ratio of the force supplied by the user onto the hand lever 3 for attaining an increased pressing force depends on the distance of the joint 13 to the joint 11, the cranked arrangement of the hand lever and the distance between the joints 7, 11. Examples of the dimensions, angles and geometries of the elements may be taken from FIG. 1 which illustrates an exemplary embodiment of the pliers 1 at a correct scale. In this way, the toggle lever drive 21 serves for attaining the second partial stroke.

When having reached the closed position illustrated in FIG. 3, all hand levers 2, 3, 4 are arranged to be parallel and at a minimal distance with respect to one another.

The return movement of the pressing pliers 1 from the closed position according to FIG. 3 into the open position according to FIG. 1 passes the intermediate position according to FIG. 2. The actuation forces, the directions of movement and the partial strokes for this purpose are designed to be reversible. When using a switching unit for fixing the hand levers 2, 4 with respect to one another during the second partial stroke, it is possible, for example, that the switching unit is automatically actuated during a closing movement of the pressing pliers 1, while the switching unit needs to be manually operated for re-attaining the open position (or vice versa).

For attaining the intermediate position according to FIG. 2, meaning the transition position between the first partial stroke and the second partial stroke, the angled end portions of the hand lever 4 and the pendulum support 17 are arranged with respect to one another to be substantially coaxial. For attaining such a position, no momentums acting upon the pressing jaw 5 are producible by the hand levers 2, 4. This limitation may be easily taken into account by a person with skill in the art, for example, by a variation of the cranked design of the hand lever 4 or by a reduced first partial stroke before changing towards the second partial stroke.

Figure 4:
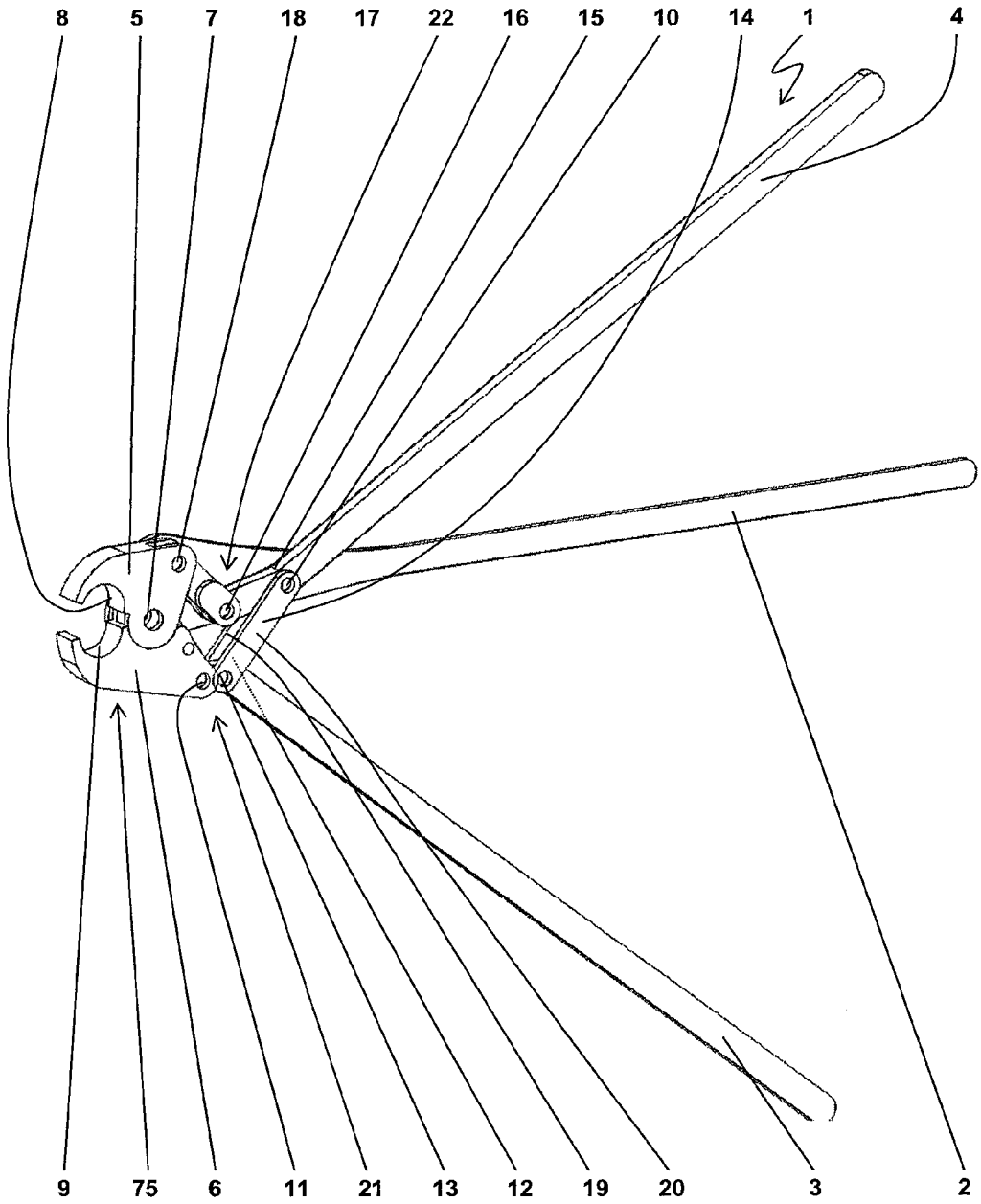
FIG. 4 is a three-dimensional view of the novel pressing pliers according to FIGS. 1 to 3 in an alternative open position at the beginning of the first partial stroke.
Figure 5:
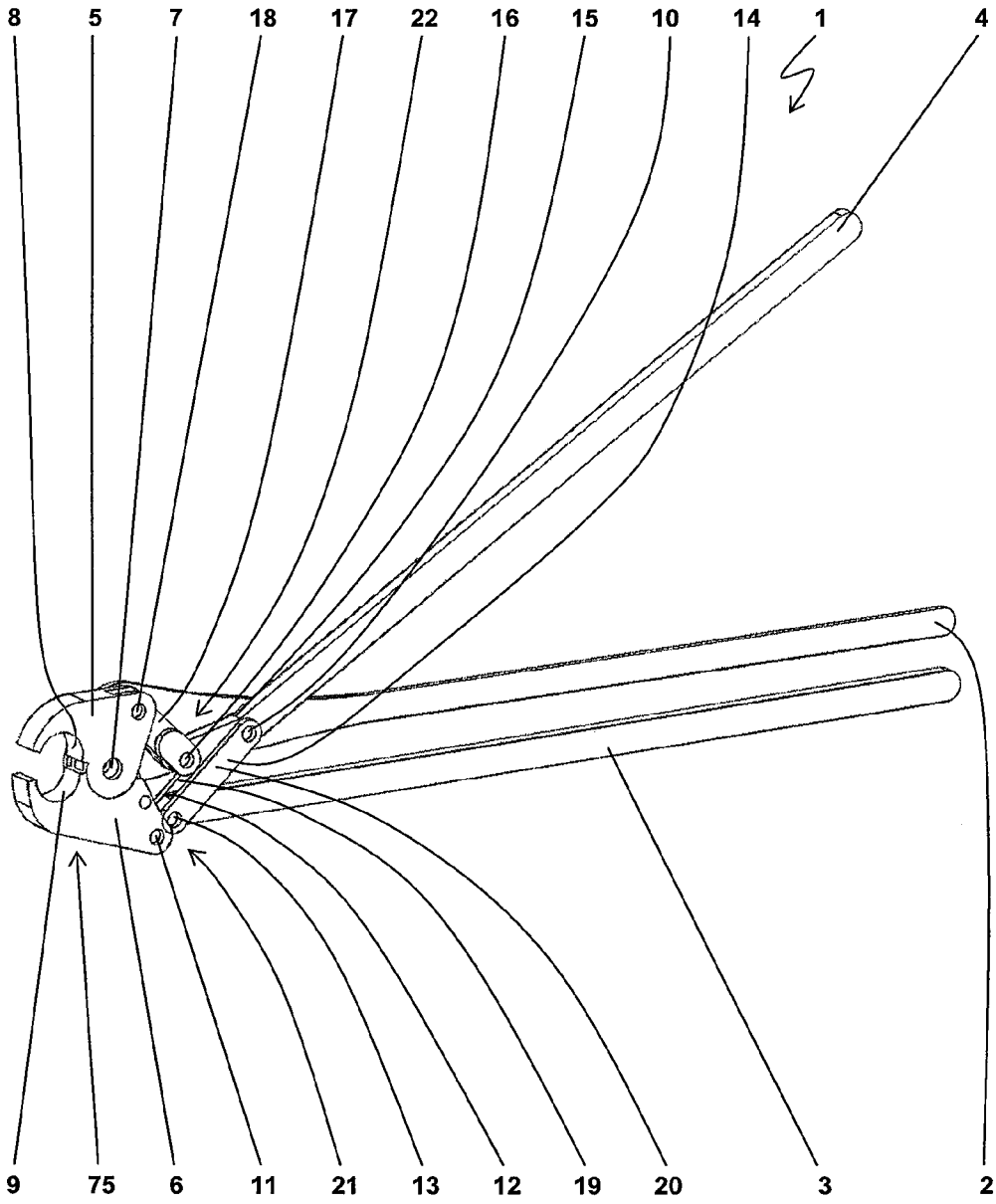
FIG. 5 is a three-dimensional view of the novel pressing pliers according to FIGS. 1 to 4 at the ending of the first partial stroke derived from the opening position according to FIG. 4.

FIGS. 4 and 5 illustrate another exemplary embodiment for actuating the pressing pliers 1 according to FIGS. 1 to 3. As it is to be seen in FIG. 4, starting from the intermediate position according to FIG. 2, the hand lever 4 for opening the pressing jaws 5, 6 is located with respect to the hand lever 2 further in an upper direction. Starting from the extended position according to FIG. 2, this results in a joint 16 being moved inwardly to an increased extent. In this way, FIG. 4 illustrates another exemplary open position of the pressing pliers 1 for which a first partial stroke (FIG. 4→FIG. 5) may begin. In case the hand levers 2, 4 are located in the position illustrated in FIG. 4 are fixedly arranged with respect to one another by a switching unit, in this exemplary embodiment of the novel pliers 1, the user may initially actuate the hand levers 2, 3 in a way that the hand levers 2, 3 are moved towards one another. The closing momentum for this first partial stroke starting in FIG. 4 and ending in FIG. 5 is then realized in a similar way as the second partial stroke as occurring between FIG. 2 and FIG. 3.

With respect to this further exemplary closing movement, FIG. 5 illustrates the intermediate position being reached. A second partial stroke will follow this intermediate position. During this second partial stroke, the hand levers 2, 3 do not change their relative position, while the hand lever 4 is moved towards the hand lever 2 (and thus towards the hand lever 3). However, when actuating the hand lever 4 to move inwardly—contrary to the first partial stroke occurring between FIGS. 1 and 2—the joint 16 is subjected in an outward direction. Consequently, the pendulum support 17 is subjected to a compressive force including a component producing a closing momentum for the pressing jaw 5 with respect to the lever arm between the joints 7, 18. In this way, the toggle lever drive mechanism 22 is active during the second partial stroke.

The exemplary embodiments of the actuation mechanism of the pressing pliers 1 according to FIGS. 1 to 5 make it clear that a closing movement may be realized by different actuation directions of a hand lever:

While the hand lever 4 during the first partial stroke from FIG. 1 to FIG. 2 is actuated by the user in an outward direction, the second partial stroke following FIG. 5 is realized by an actuation of the hand lever 4 in an inward direction. In case a respective switching unit is arranged, it is also possible that—starting from the starting position illustrated in FIG. 4—a first partial stroke is not realized by a movement of the hand levers 2, 3 into the intermediate position illustrated in FIG. 5, but instead by an initial approaching movement of the hand levers 2, 4.

FIGS. 6 to 10 illustrate another exemplary embodiment of the novel pliers 30 and their elements. Generally, the functionality of the pliers 30 is similar to the one of the pliers 1 illustrated in FIGS. 1 to 5. However, FIGS. 6 to 20 illustrate an advantageous design of the pressing pliers 30 having additional advantageous functions, simplifications and additional elements.

In contrast to the pressing pliers 1, the pressing pliers 30 only include two hand levers 31, 32. In this case, the hand lever 31 fulfills the functions of the hand levers 2, 4 as used in the pressing pliers 1 according to FIGS. 1 to 5. This is realized by the hand lever 31 being designed to be switchable by a switching unit 33. This means that it is possible to change the distribution of forces and the kinematics as well as possible degrees of freedom of the hand lever 31 with respect to the associated pressing jaw 5 by the switching unit 33.

Figure 7:
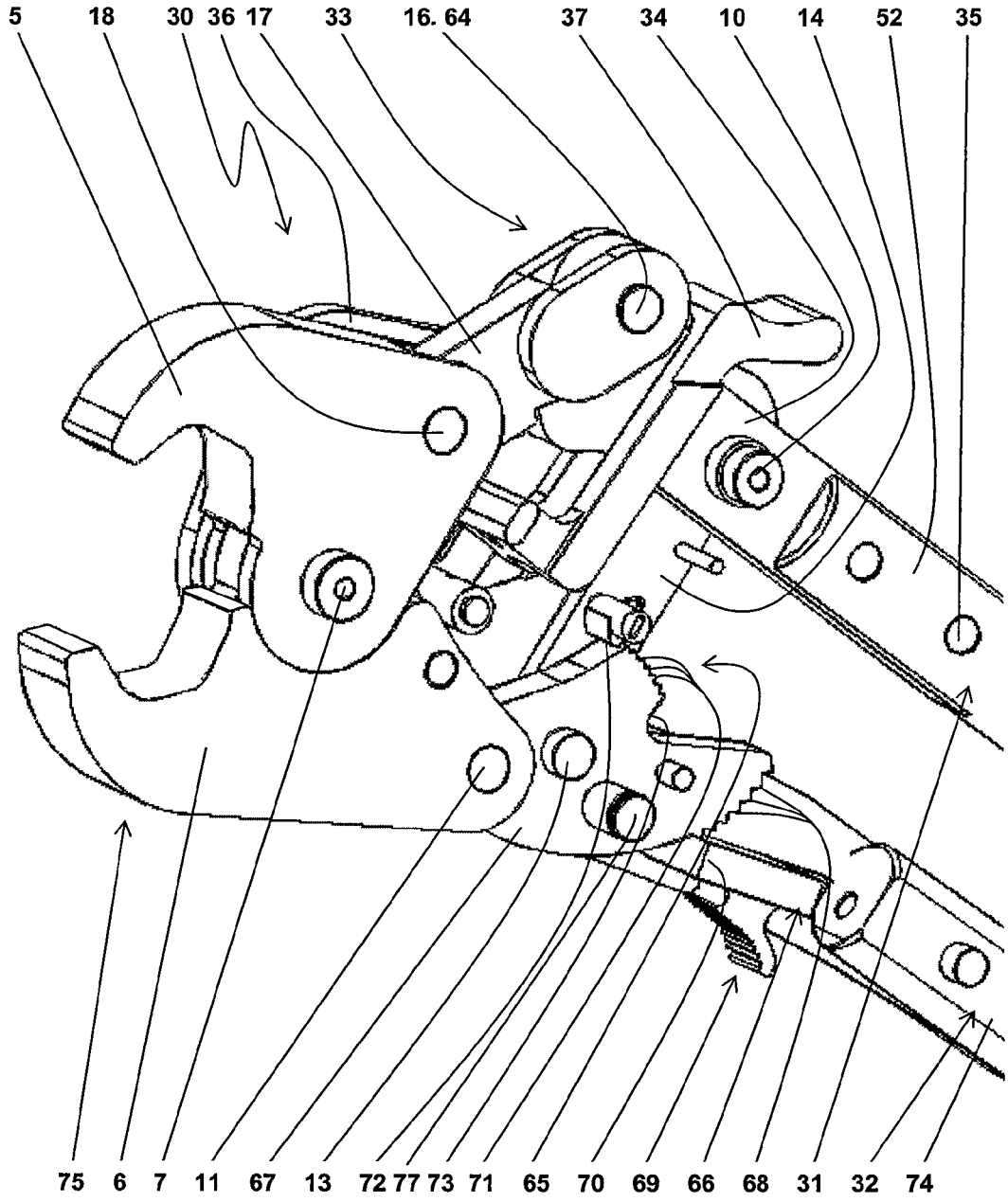
FIG. 7 is an enlarged view of the pliers head of the pressing pliers of FIG. 6.

The head 75 of the pressing pliers 30 is illustrated in FIG. 7 at an enlarged scale. Elements having substantially the same function as the ones illustrated in FIGS. 1 to 5 are designed with the same reference numerals. Due to the fact that these designs and connections to adjacent elements have already been described above, it is referred to the above description.

The hand lever 31 includes and end piece 34 which is fixedly connected to a handle piece 52 of the hand lever 31 by a connection element 35. The end piece 34 is connected to a support plate or guiding plate 36 by the joint 10. The plate 36 is partly covered in the illustration of FIG. 7, but it is illustrated in detail in FIGS. 18 to 20. The guiding plate 36 may be compared to a hand lever 2 being shortened to the pliers head 75 of the pressing pliers 1 according to FIG. 1, the shortened hand lever 2 in the fixed switching position of the switching unit 33 being extended by the hand lever 32. The end piece 34 in its end portion facing away from the handle piece 52 is pivotally connected to the pendulum support 17 by the joint 16.

Furthermore, FIG. 7 illustrates an actuation element 37 being part of the switching unit 33. The functionality of the actuation element 37 is to be seen from the following description.

It is to be seen in FIGS. 11 to 14 that the actuation element 37 is designed to be L-shaped and to include a vertical base leg 38 and a lateral leg 39. The base leg 38 in its end portion opposite to the lateral leg 39 includes an actuation portion 40 being angled at approximately 60° to 80°. The upper side of the actuation portion 40 includes a dell 41 by which the actuation element 37 may be actuated in the direction of the longitudinal axis of the base leg 38, for example by a thumb of the user. The lateral leg 39 in its end portion opposite to the base leg 38 includes protrusions 42, 43 being located transverse to the plane of illustration of FIG. 11. Furthermore, the actuation element 37 in the region of the base leg 38 includes extensions in the form of guiding flanks 44, 45. The actuation element 37 in the region of its base leg 38 includes a continuous channel 46 being located in the longitudinal direction. The channel 46 is connected to the transition portion with respect to the lateral legs, and it ends at a stop surface 47 in the lateral leg 39. The lateral leg 39 at its bottom side includes a pocket hole 48.

Figure 15:
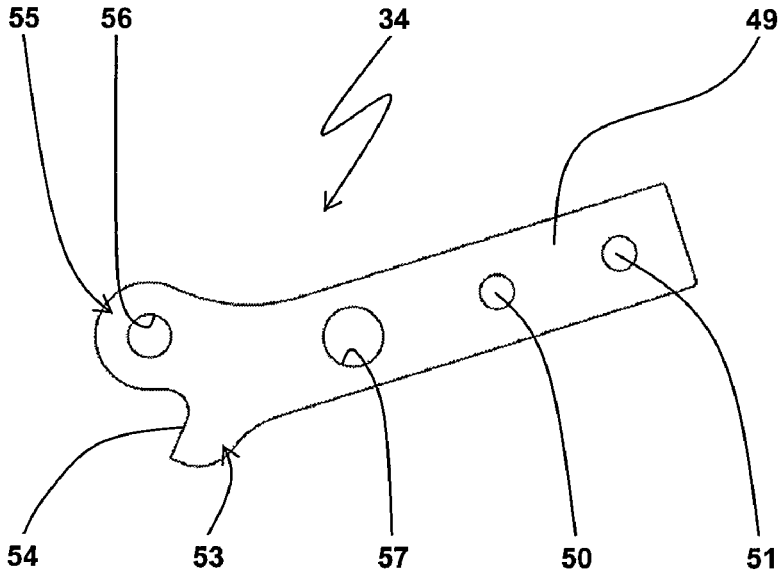
FIG. 15 is a side view of a hand piece of a hand lever of the novel pressing pliers.
Figure 16:
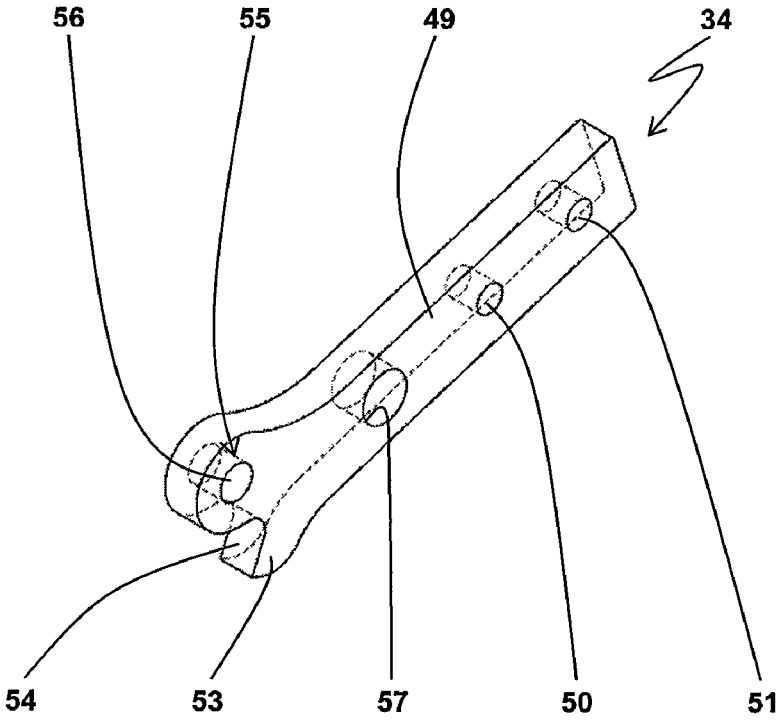
FIG. 16 is a three-dimensional view of the end piece according to FIG. 15.
Figure 17:
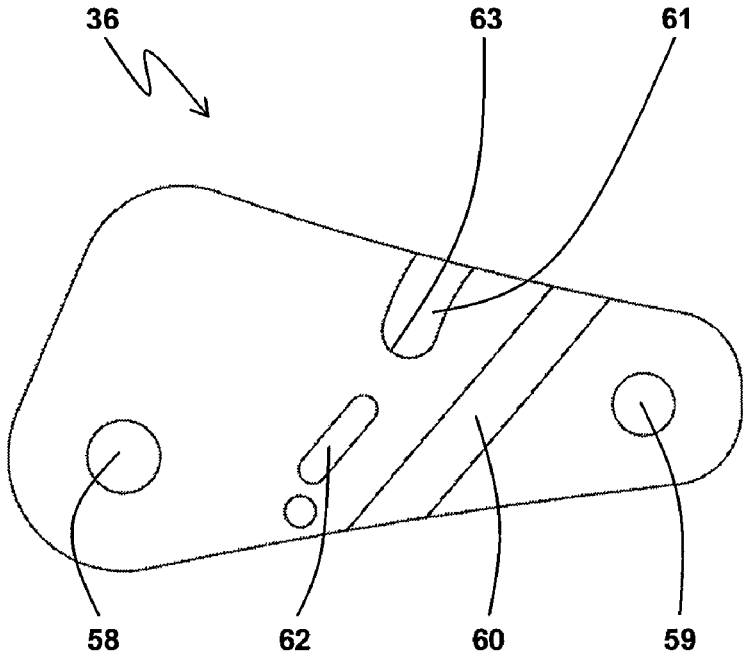
FIG. 17 is a side view of a guiding plate of the novel pressing pliers.

According to FIGS. 15 to 17, the end piece is designed to be approximately Y-shaped. A base leg 49 of the Y is designed to be straight and to include two bores 50, 51 allowing for connection of the end piece 34 to the handle piece 52. A plain supporting surface 54 is formed in the region of the leg 53 of the Y, while the leg 53 at the side opposite to the supporting surface 54 is designed to be rounded and to be connected to the base leg 49. The other leg 55 of the Y forms a bearing lug 56 for the joint 16. Furthermore, the end piece 34 includes a bore 57 for the joint 10.

Figure 18:
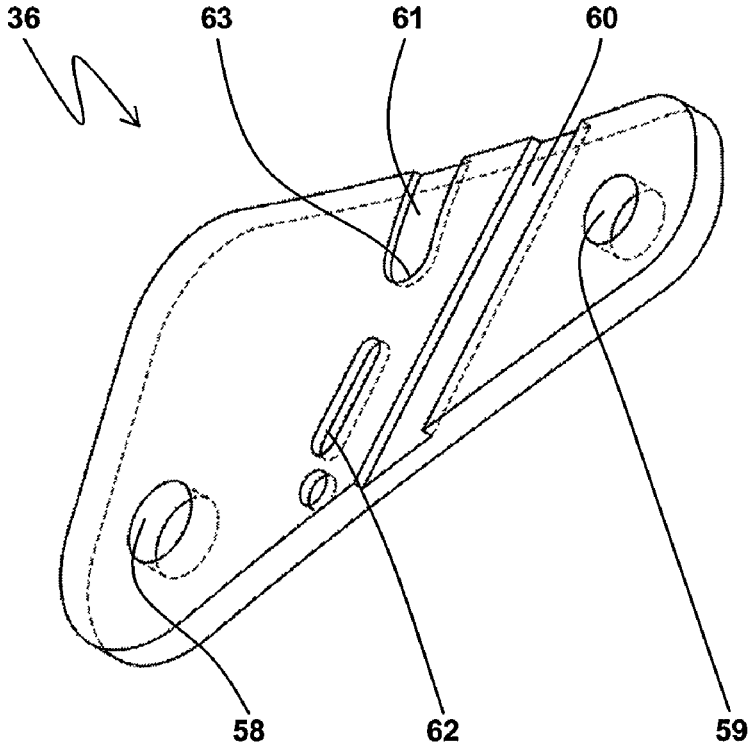
FIG. 18 is a three-dimensional view of the guiding plate according to FIG. 17.

FIGS. 17 and 18 are unit drawings of the guiding plate 36. The guiding plate 36 in its end portions each includes a support or bore 58, 59 for the joint 10 and the joint 7. Furthermore, a guiding channel 60 is located in the guiding plate 36. According to FIG. 17, the guiding channel 60 is designed to be continuous from an upper side towards a bottom side and to be angled with respect to the connecting axis of the bores 58, 59. The guiding channel 60 is designed to be straight. Furthermore, a guiding channel 61 is located in the guiding plate 36, the guiding channel 61 extending from the upper side into the guiding plate 36. The guiding channel 61 has a slightly curved design, and it does not extend to the bottom side of the guiding plate 36. The guiding channel 61 ends at a channel end 63. A third guiding channel 62 is located inside of the guiding plate 36, and it is thus neither connected to the upper side nor to the bottom side.

FIG. 7 illustrates the pressing pliers 30 in their mounted condition, the upper guiding plate 36 of two guiding plates 36 being located at both sides of the pliers head 75 having been removed to provide an insight into the interior of the pliers head 75. In the fully mounted position of the pliers 30, the guiding flanks 44, 45 are each guided in guiding channels 60 of the guiding plates 36. This results in guidance of the actuation element 37 in the direction of the guiding channel 60. The protrusions 42, 43 are guided in the guiding channel 62. A pre-tensioned pressure spring is supported in the pocket hole 48 in a way that the actuation element 37 in the most released position of the pressure spring is pushed out off the guiding plate 36 in an upward direction such that the protrusions 42, 43 contact the upper edge of the guiding channel 62. This position of the actuation element 37 is to be seen in FIGS. 6 and 7.

During the first partial stroke (FIG. 6→FIG. 8) the joint 16 pivots in an inward direction during continued pivotal movement of the hand levers 31, 32 in a direction away from one another. A journal 64 of the joint 16 enters into the channel 61 during continued pivotal movement until the journal 64 contacts the channel end 63 at the ending of the first partial stroke. In this way, a fixed end position for the first partial stroke is predetermined. The channel end 63 thus forms a single-side stop for limiting the pivotal movement between the hand lever 31, the pendulum support 17, the guiding plate 36 and the pressing jaw 5. The stop prevents relative movement of the hand lever 31 with respect to the hand lever 32 in a further outward direction.

When reaching the ending of the first partial stroke, fixation in the opposite direction is additionally attained as follows: during continued pivotal movement of the hand lever 31 and movement of the joint 16 in an inward direction, the leg 53 of the end piece 34 further approaches the lateral leg 39 of the actuation element 37 until the leg 53 with its rounded limiting surface contacts the upper side of the lateral leg 39. During continued pivotal movement within the first partial stroke, the leg 53 presses the lateral leg 39 and thus the actuation element 37 in a downward direction along the guiding channels 60, 62 which results in subjection of the pressure spring (not illustrated). When reaching the ending of the first partial stroke and when the journal 64 contacts the channel end 63, the end piece 34 is pivoted to such an extent that the supporting surface 54 of the end piece 34 is pivoted beyond the supporting surface 47 of the actuation element 37 such that the leg 53 may enter the channel 46 of the actuation element 37. Thus, at the ending of the first partial stroke, the pressure spring presses the actuation element 37 back in an outer direction while there is relative movement between the supporting surfaces 47, 54. In this condition, the hand levers 31 with the end piece 34, the pendulum support 17 and the pressing jaw 5 form a fixed, non-pivotable part of the pliers. In the following, the second partial stroke may begin. In one pivotal direction, one attains a determination by contact of the supporting surfaces 47, 54 at each other and in the other pivotal direction by contact of the journal 64 at the channel end 63.

The kinematics of the second partial stroke substantially correspond to the ones disclosed in German Patent No. DE 103 46 241 B3. It is possible to use a forced locking mechanism 65 as well as a stop locking mechanism 66 at the moved portion of the pliers. The hand lever 32 includes a partial lever 67, the hand lever 32 in the region of the partial lever 67 being connected to the joint 11. Via the stop locking mechanism 66, the angle between the handle piece 74 of the hand lever 32 and the partial handle 67 may be changed independent from the position of the pressing jaws 5, 6 as follows: for this purpose, the partial lever 67 in the portion facing the handle piece 74 includes stops 68 being designed and arranged on the circumference of the first partial lever 67 in series or arc-shaped. The stops 68 cooperate gradually with a manually operable spring-biased ratchet unit 69. The ratchet unit 69 includes a locking element 70 being subjected towards the stops 68 by a spring (not illustrated). The shape of the stops 68 and of the locking element 70 is coordinated in a way that one stop 68 and the locking element 70 form a locking connection during actuation of the hand levers 31, 32 towards one another. Consequently, the angle position between the partial lever 67 and the hand piece 74 of the hand lever 32 is continued in this direction. However, such a movement of the hand levers 32, 31 away from one another results in a pitch of the adjacent stop 68 pressing the locking element 70 back while the spring is subjected until the locking element 70 engages an adjacent stop 68. With respect to further design aspects and details, it is referred to the above described prior art references and the pressing pliers including a stop locking mechanism as they are commercially available. For the illustrated exemplary embodiment, the degree of freedom required for the stop locking mechanism is realized by a joint 77 between the partial lever 67 and the hand lever 32. Without departing from the general inventive concept, it is possible to choose a variation in which the joint 77 is designed as a common joint by one of the joints 11, 13. It is also referred to the various embodiments illustrated in German Patent No. DE 103 46 241 B3 which are incorporated by reference herewith.

To attain the forced locking mechanism 65, the circumference of the partial lever 67 includes tooth segments 71 with respect to the joint 13, the tooth segments 71 cooperating with a locking element 72 being supported with respect to the pressure lever 14 in a spring-biased way. The shapes of the locking element 72 and of the tooth segments 71 are chosen such that when approaching the hand levers 31, 32 with respect to one another, the locking element 72 engages adjacent tooth segments 71 one after the other. Due to the shapes of the tooth segments 71 and of the locking element 72, the forced locking mechanism 65 prevents movement of the hand levers 32, 31 in a direction away from each other and thus a reopening pivotal movement of the pressing jaws 5, 6. Additional design possibilities and/or details of a forced locking mechanism 65 are to be seen from the above referenced prior art references and the commercially available prior art pressing pliers including a forced locking mechanism 65.

Figure 6:
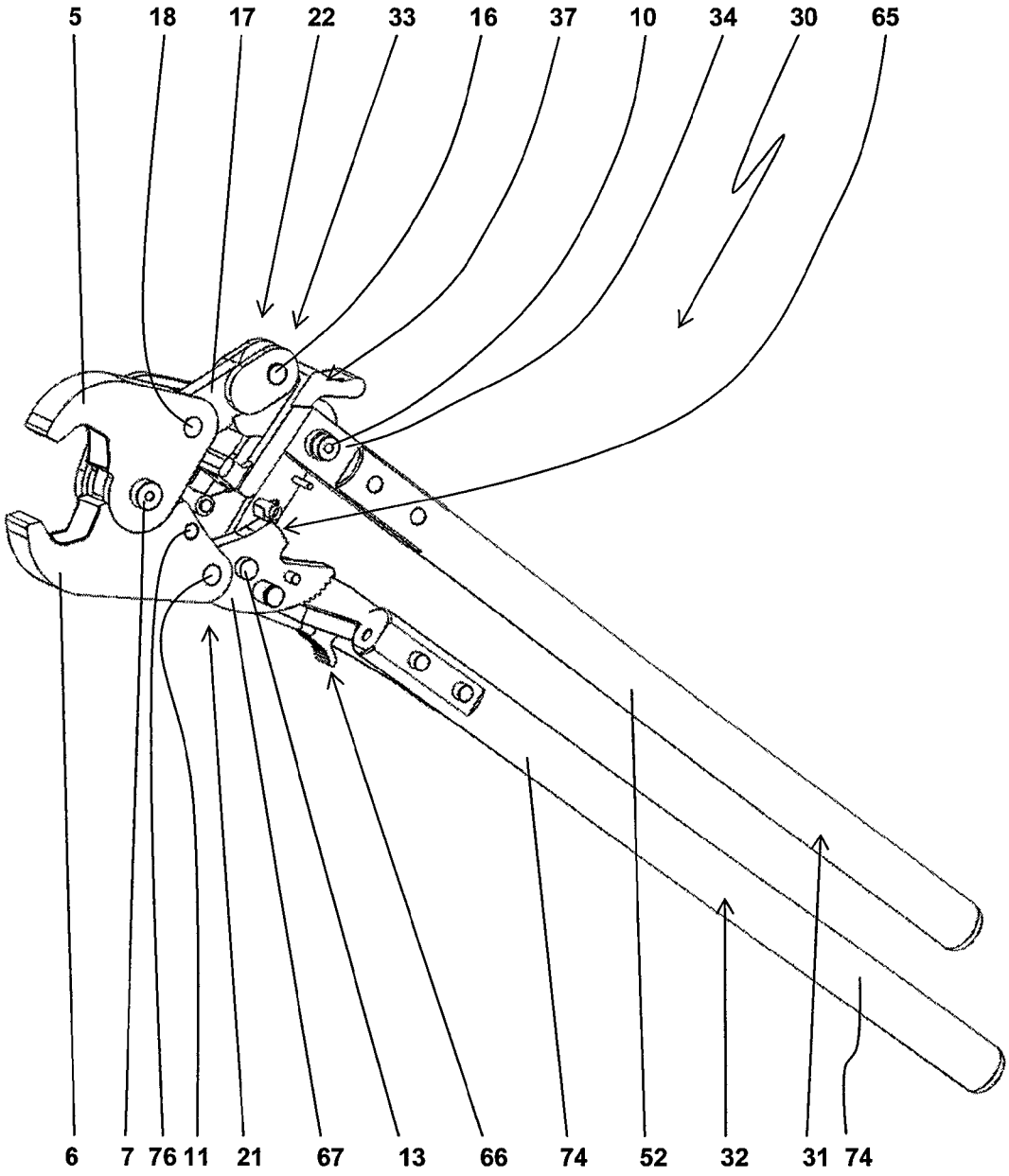
FIG. 6 is a three-dimensional view of a second exemplary embodiment of the novel pressing pliers including two hand levers, a switching unit, a forced locking mechanism and a stop locking mechanism in their open position at the beginning of a first partial stroke.

Consequently, during the second partial stroke, there is a movement of the locking elements 72 from the position illustrated in FIG. 7 beyond all tooth segments 71. To make it possible, starting from the beginning of the second partial stroke according to FIG. 9, that the hand levers 31, 32 are grasped by one hand or by both hands of the user, the hand levers 31, 32 may be moved towards one another at the beginning of the second partial stroke due to the stop locking mechanism for an unchanged position of the pressing jaws 5, 6. This correlates to a movement of the locking element 70 with respect to the outer stop 68. The pressing jaws 5, 6 may be moved towards one another in a pressing step, the position of the pressing jaws 5, 6 as it once has been reached being secured by the forced locking mechanism 65. For a next pressing step, the stop locking mechanism 66 is actuated in a way that the locking element 70 cooperates with an adjacent stop 68. In the following pressing step, the pressing jaws 5, 6 may further approach one another while being secured by the forced locking mechanism 65. This process is repeated for some pressing steps, for example six, seven, eight, nine, ten or even more than ten pressing steps. At the ending of the second partial stroke, the locking element 72 engages a dell 73 of the partial lever 67. Starting from this condition, the locking element 72 may return to the starting position illustrated in FIG. 7. A ratchet unit 69 may also be manually operated for manually changing the stop locking mechanism 66. During the first partial stroke from FIG. 6 to FIG. 8, the stop locking mechanism 66 is located in its maximum outwardly deflected position such that the pivotal degree of freedom between the partial lever 67 and the hand piece 74 is locked. The functionality of the pressing pliers 30 may be explained as follows:

According to FIG. 6, the pressing pliers 30 are located in the open position in which the die halves are located at their maximum distance. In this open position, the hand levers 31, 32 are located at a minimal distance such that the pressing pliers 30 may be moved over a work piece even when there is little available space.

Figure 8:
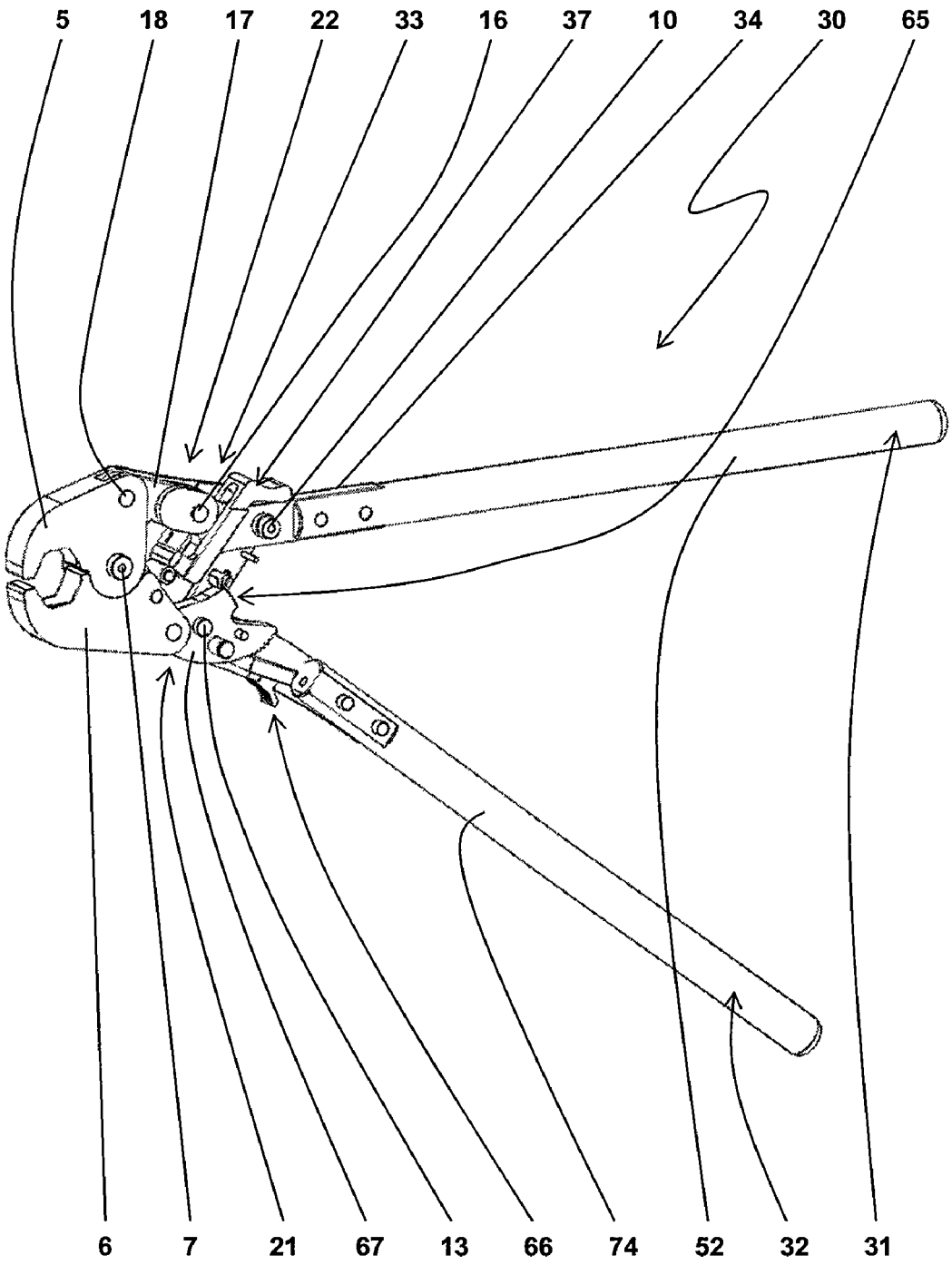
FIG. 8 is a three-dimensional view of the pressing pliers according to FIGS. 6 and 7 at the ending of the first partial stroke, the switching unit not being actuated such that the first transfer mechanism is active.

For attaining the first partial stroke from FIG. 6 to FIG. 8, the hand levers 31, 32 are pivoted by the user in a direction away from one another, the stop locking mechanism 66 being in its maximum outwardly pivoted position such that it is locked. Furthermore, the forced locking mechanism 65 is located in its maximum open position which is the locked position.

The toggle lever drive 22 is active during the first partial stroke. Pivotal movement of the pressing jaw 6 in a further outward direction may be limited in one direction by a stop pin. For example, the stop pin may be arranged to be guided in a suitable channel in the guiding plate 66, the channel being restricted at one side.

Figure 9:
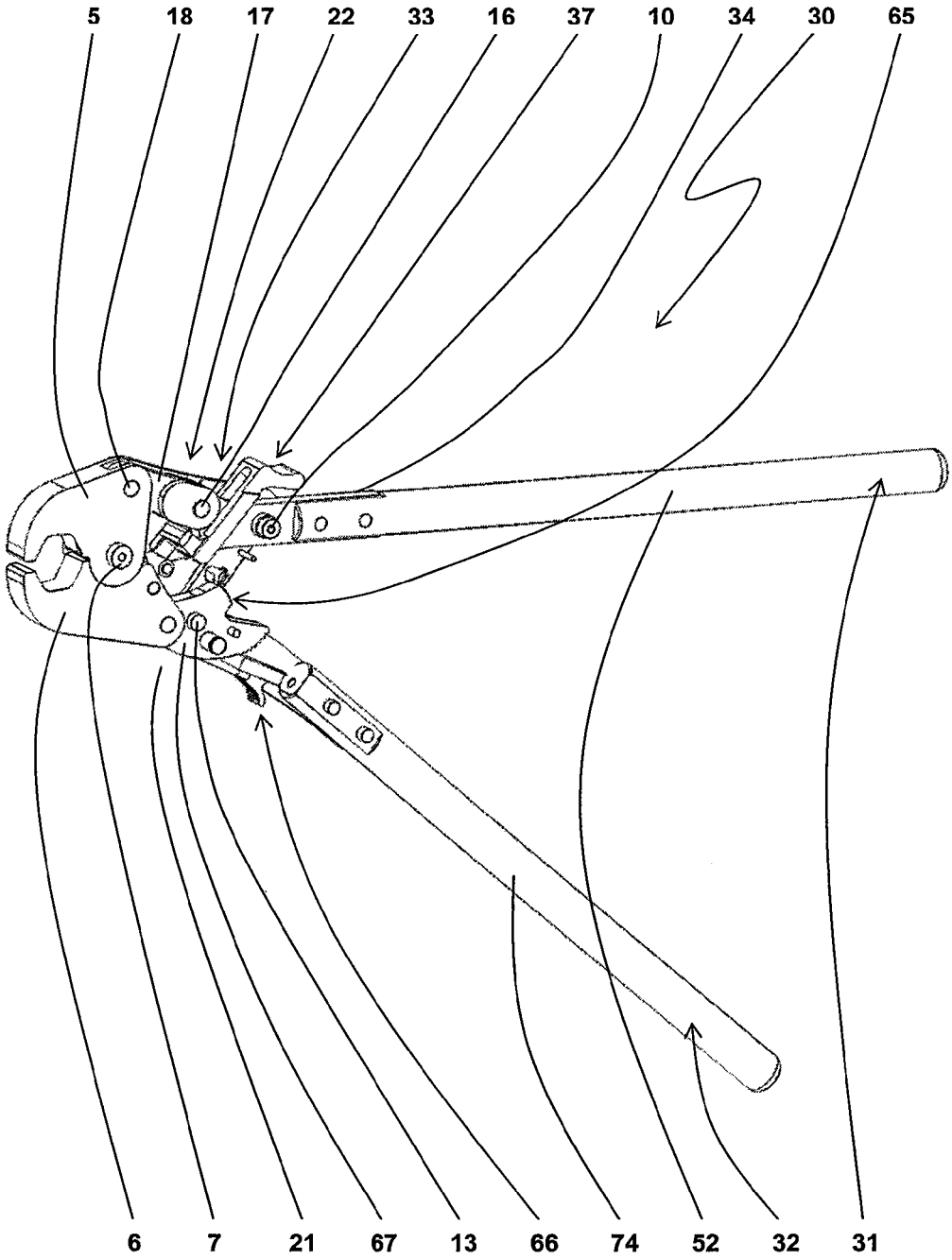
FIG. 9 is a three-dimensional view of the pressing pliers according to FIGS. 6 to 8 at the ending of the first partial stroke, the switching mechanism being actuated such that the second transfer mechanism is active.

The transition from the first partial stroke towards the second partial stroke as occurring from FIG. 8 to FIG. 9 is realized by the actuation element 37 being moved in an outward direction in a spring-biased way and by the contact of the journal 64 at the channel end 63 as well as by the contact of the contact surface 47 at the contact surface 54 resulting in the degree of freedom of the toggle lever drive mechanism 22 being locked.

Figure 10:
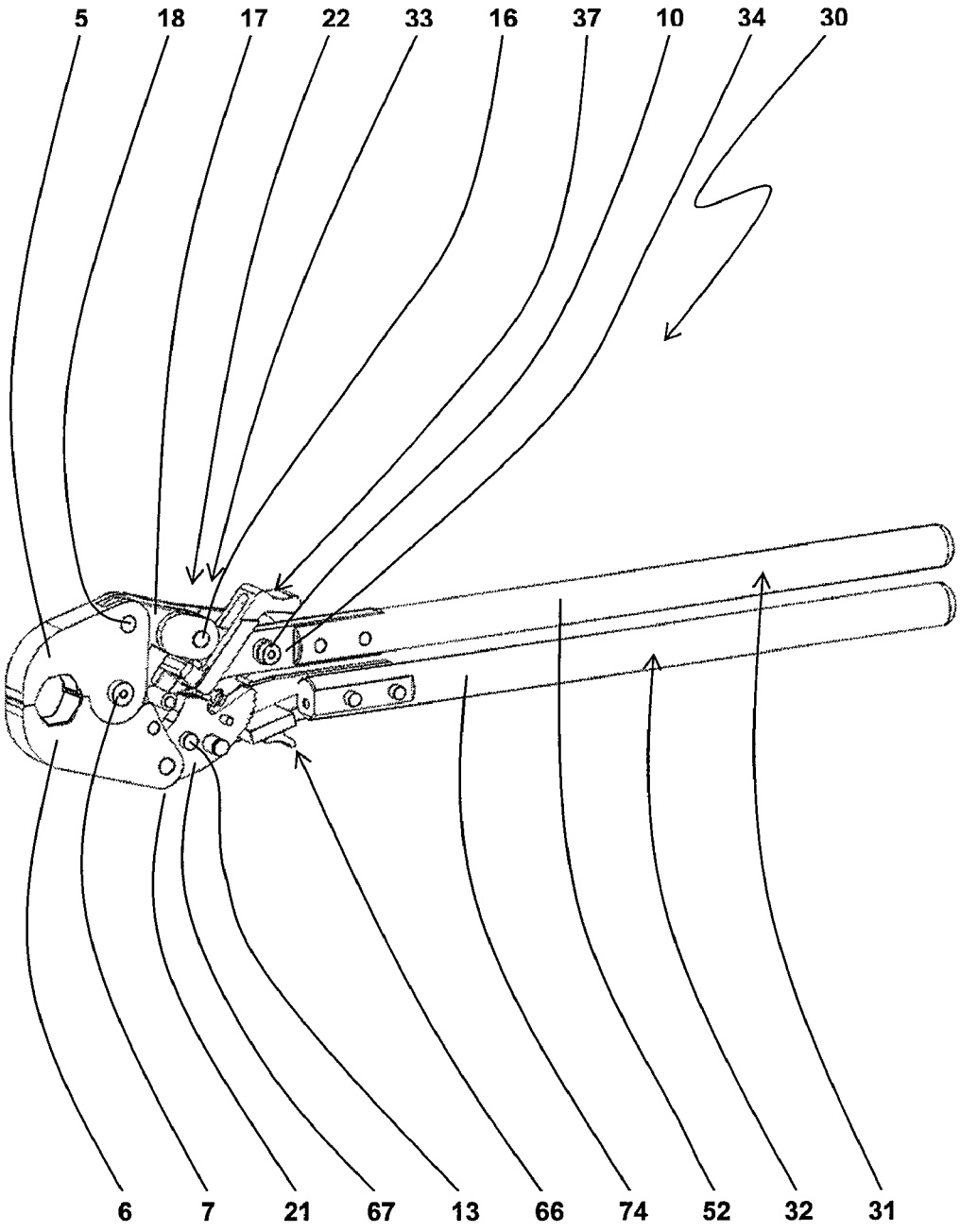
FIG. 10 is a three-dimensional view of the pressing pliers according to FIGS. 6 to 9 at the ending of the second partial stroke in their closed position.
Figure 11:
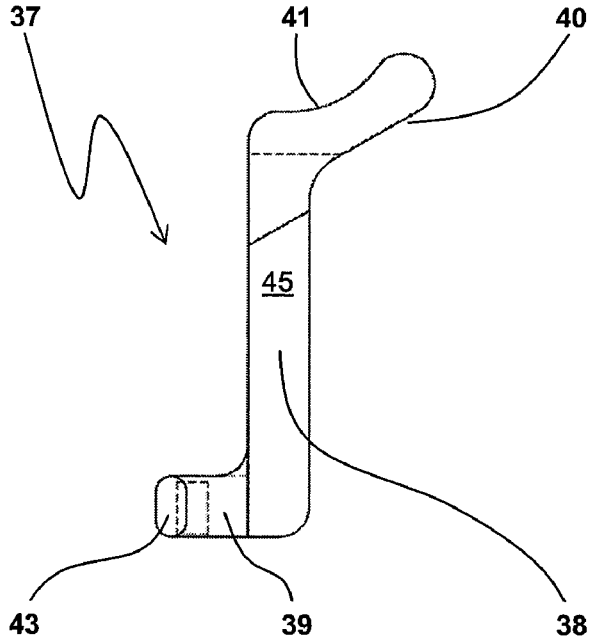
FIG. 11 is a side view of an actuation element of the novel pressing pliers.
Figure 12:
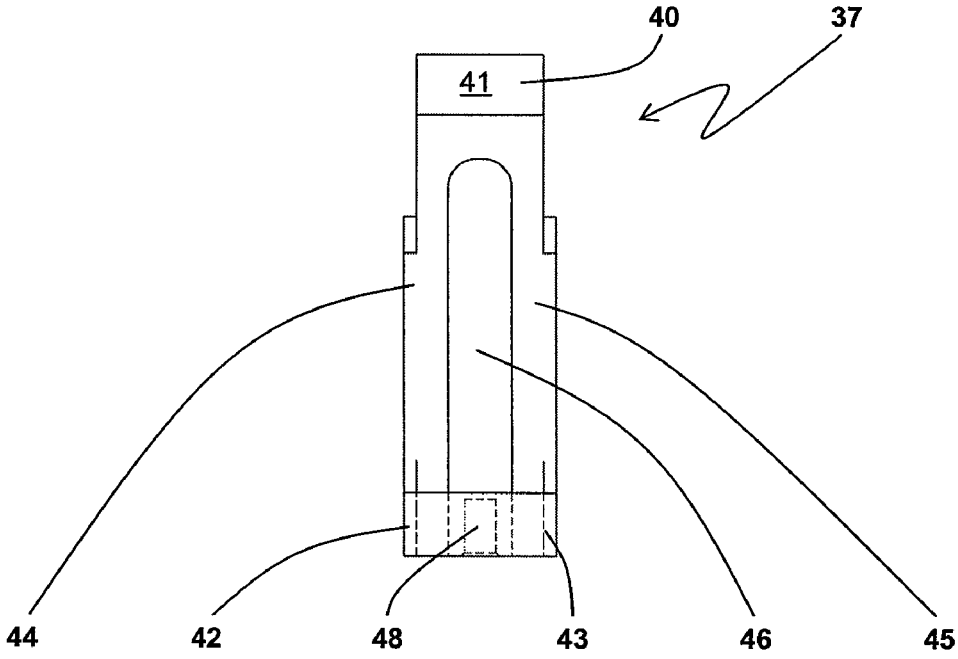
FIG. 12 is a front view of the actuation element according to FIG. 11.
Figure 13:
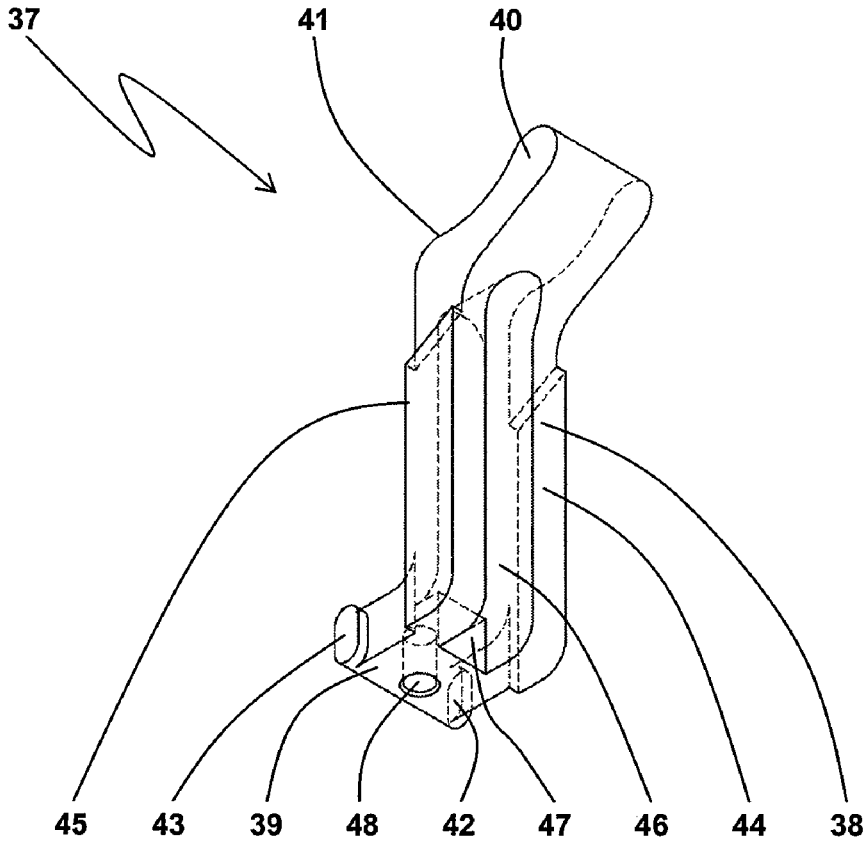
FIG. 13 is a three-dimensional view from below of the actuation element according to FIGS. 11 and 12.
Figure 14:
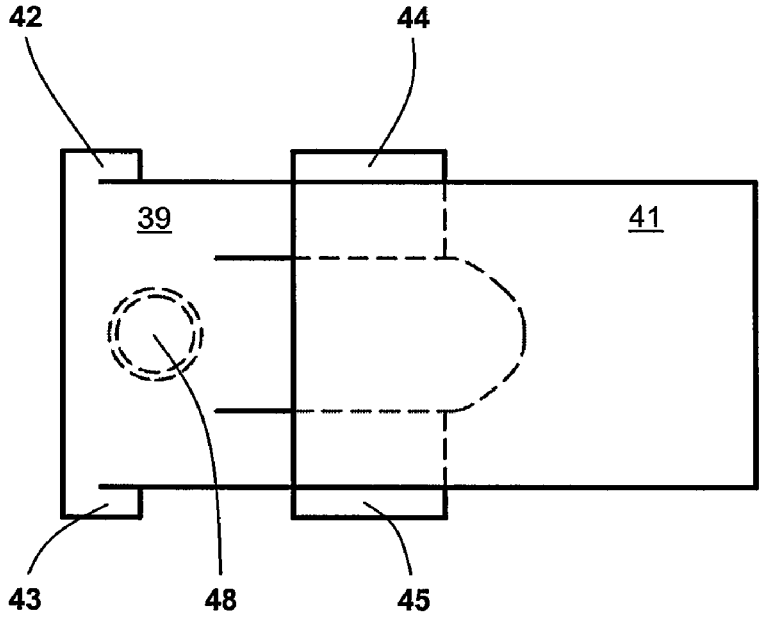
FIG. 14 is a top view of the actuation element according to FIGS. 11 to 13.

For attaining the second partial stroke as occurring from FIG. 9 to FIG. 10, the hand lever 31 is part of a fixed pliers half, while pressing occurs in a plurality of pressing steps by the toggle lever drive mechanism 21 with the collaboration of the forced locking mechanism 65 and the stop locking mechanism 66 during movement of the hand lever 32 in the direction of the hand lever 31.

It is also possible to use different supporting locations and supporting points as well as kinematics for realizing the novel pliers. For example, German Patent No. DE 103 46 241 B3 being incorporated by reference herewith illustrates an embodiment in which the partial lever 68 is supported at different locations by separate joints at the pressing jaw 6, on the one hand, and at the handle piece 74, on the other hand, in such an embodiment, the pressure lever is also supported by a separate joint. Without departing from the spirit of the present invention, support may be realized in a joint by an eccentric journal such that it is possible to adjust and/or readjust the pressing pliers (see German Patent No. DE 103 46 241 B3 being incorporated by reference herewith). The structural elements of the pressing pliers 1, 30 may be designed as a solid construction or to include a plurality of plates. Furthermore, it is possible to design the die halves to be replaceable (see German Patent No. DE 199 24 087 C2 being incorporated by reference herewith) and to arrange them in the pressing jaws 5, 6 with a clearance allowing for centering adjustment in the direction of the separation plane of the die halves. For a simplified design of a stop locking mechanism, two partial levers of the pliers half which is moved may be connected by a joint, for example a pin being located in two angled channels, to be lockable in two angle positions, as this is disclosed in German Patent No. DE 199 63 097 C1 being incorporated by reference herewith.

Contrary to the illustrated exemplary embodiments, the hand levers 2, 3, 4 of the pressing pliers 1 in the direction of the end portions opposite to the pliers head may be designed to be tapered in a diminishing way, the distance between the inner sides of the hand levers being increased while the outer sides of the hand levers being parallel. Under consideration of the bending load of the hand levers, material and weight can be reduced by this measure. On the other hand, it is possible to further approach the hand levers due to this measure.

Many variations and modifications may be made to the preferred embodiments of the invention without departing substantially from the spirit and principles of the invention. All such modifications and variations are intended to be included herein within the scope of the present invention, as defined by the following claims.

I claim:

1. Pliers for pressing work pieces, comprising:

a first hand lever;

a second hand lever, said first and second hand levers being designed and arranged to be movable with respect to one another;

a head;

at least two pressing jaws, said pressing jaws being located in the region of said head and being designed and arranged to approach one another during a working stroke of said pliers to press a work piece, the working stroke including a first partial stroke and a second partial stroke wherein said pressing jaws are located in an open position when said hand levers are located in a closed position;

a first transfer mechanism, said first transfer mechanism being formed by a first toggle lever drive, said first toggle lever drive including a first toggle joint being formed by a first joint, said first toggle lever drive being designed and arranged to transmit forces applied by a user to said hand levers to said pressing jaws to produce a first pressing force during the first partial stroke, the first pressing force being applied by each of the at least two pressing jaws in a crimping direction towards the work piece wherein the first transfer mechanism is designed and arranged to attain the first partial stroke by moving said first and second hand lever with respect to one another in a first direction; and a second transfer mechanism, said second transfer mechanism being formed by a second toggle lever drive, said second toggle lever drive including a second toggle joint being formed by a second joint, said second toggle lever drive being designed and arranged to transmit forces applied by a user to said hand levers to said pressing jaws to produce a second pressing force during the second partial stroke, the second pressing force being applied by each of the at least two pressing jaws in the crimping direction towards the work piece wherein the second transfer mechanism is designed and arranged to attain the second partial stroke by moving said first and second hand lever with respect to one another in a second direction other than the first direction.

2. The pliers of claim 1, further comprising a third hand lever.

3. The pliers of claim 1, further comprising a switching unit, said switching unit being designed and arranged to switch from said first transfer mechanism to activate said second transfer mechanism.

4. The pliers of claim 3, wherein said switching unit is designed and arranged to determine a degree of freedom.

5. The pliers of claim 3, wherein said switching unit includes a manual actuation element, said manual actuation element being designed and arranged to switch from said first transfer mechanism to activate said second transfer mechanism.

6. The pliers of claim 3, wherein said switching unit is designed and arranged to automatically switch from said first transfer mechanism to activate said second transfer mechanism.

7. The pliers of claim 3, further comprising:

a pendulum support, said pendulum support having a first end portion and a second end portion;

said first end portion being pivotally connected to said first hand lever during the first partial stroke, said second end portion being pivotally connected to said first pressing jaw, said pendulum support and said first hand lever being designed and arranged to form said first toggle lever drive including a toggle lever, said toggle lever being formed by said first joint being located between said pendulum support and said first hand lever, said second hand lever being directly pivotally connected to said second pressing jaw during the second partial stroke, said second hand lever and said second pressing jaw being designed and arranged to form said second toggle lever drive including a toggle lever, said toggle lever being formed by said second joint being located between said second hand lever and said second pressing jaw.

8. The pliers of claim 7, wherein said switching unit is designed and arranged to determine the pivotal degree of freedom of said pendulum support with respect to said first hand lever in an end portion of said pendulum support facing away from said first pressing jaw.

9. The pliers of claim 1, further comprising:

a pendulum support, said pendulum support having a first end portion and a second end portion;

said first end portion being pivotally connected to said first hand lever during the first partial stroke, said second end portion being pivotally connected to said first pressing jaw, said pendulum support and said first hand lever being designed and arranged to form said first toggle lever drive including a toggle lever, said toggle lever being formed by said first joint being located between said pendulum support and said first hand lever, said second hand lever being directly pivotally connected to said second pressing jaw during the second partial stroke, said second hand lever and said second pressing jaw being designed and arranged to form said second toggle lever drive including a toggle lever, said toggle lever being formed by said second joint being located between said second hand lever and said second pressing jaw.

10. The pliers of claim 1, wherein said second hand lever includes a stop locking mechanism, said stop locking mechanism being designed and arranged to locate parts of said second hand lever at defined different angle positions with respect to one another.

11. The pliers of claim 1, further comprising a forced locking mechanism, said forced locking mechanism being designed and arranged to secure defined intermediate positions of said pressing jaws in one direction during the working stroke.

* * * * *